US011293685B2

(12) United States Patent
Han et al.

(10) Patent No.: US 11,293,685 B2
(45) Date of Patent: Apr. 5, 2022

(54) REFRIGERATOR

(71) Applicant: LG ELECTRONICS INC., Seoul (KR)

(72) Inventors: Junsoo Han, Seoul (KR); Younseok Lee, Seoul (KR); Dongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 223 days.

(21) Appl. No.: 16/534,256

(22) Filed: Aug. 7, 2019

(65) Prior Publication Data

US 2019/0360740 A1 Nov. 28, 2019

Related U.S. Application Data

(63) Continuation of application No. 15/868,180, filed on Jan. 11, 2018, now Pat. No. 10,422,568.

(30) Foreign Application Priority Data

Mar. 10, 2017 (KR) ..... 10-2017-0030598

(51) Int. Cl.
*F25D 23/00* (2006.01)
*F25D 11/02* (2006.01)
(Continued)

(52) U.S. Cl.
CPC ..... *F25D 23/006* (2013.01); *F25D 11/02* (2013.01); *F25D 17/065* (2013.01);
(Continued)

(58) Field of Classification Search
CPC .... F25D 23/006; F25D 17/067; F25D 17/065; F25D 23/069; F25D 11/02; F25D 2500/02; F25D 23/06; F25D 23/062
See application file for complete search history.

(56) References Cited

U.S. PATENT DOCUMENTS 3,050,961 A * 8/1962 Mann ..... F25D 17/065 62/419
3,104,533 A * 9/1963 O'Connell ..... F25D 17/065 62/414

(Continued)

FOREIGN PATENT DOCUMENTS

CH 711098 11/2016
DE 20 2005 014 370 8/2006

(Continued)

OTHER PUBLICATIONS

European Search Report dated Sep. 18, 2019 issued in EP Application No. 19178688.8.

(Continued)

*Primary Examiner* — Kun Kai Ma
(74) *Attorney, Agent, or Firm* — Ked & Associates LLP

(57) ABSTRACT

A refrigerator includes a partition wall provided between first and second storage chambers and having a partition wall insulator, an evaporator case arranged in the partition wall and communicating with the first and second storage chambers, an evaporator installed inside the evaporator case, a grill cover provided on a rear side of the evaporator case and configured to accommodate a blower fan, and support guides provided in the grill cover and supporting a rear portion of the evaporator, such that an internal storage space of the refrigerator is increased, and a withdrawal distance of a drawer provided in the refrigerator is increased.

23 Claims, 26 Drawing Sheets

(51) Int. Cl.
*F25D 23/06* (2006.01)
*F25D 17/06* (2006.01)

(52) U.S. Cl.
CPC ..... *F25D 17/067* (2013.01); *F25D 23/069* (2013.01); *F25D 2500/02* (2013.01)

(56) References Cited

U.S. PATENT DOCUMENTS 3,105,364 A * 10/1963 O'Connell ..... F25D 21/002 62/156
3,138,006 A * 6/1964 Moorman ..... F25D 17/065 62/156
3,283,528 A * 11/1966 Palm ..... F25D 17/065 62/187
3,288,370 A * 11/1966 Mingrone ..... F25D 17/045 236/49.5
3,316,729 A * 5/1967 Mann ..... F25D 21/002 62/156
3,466,891 A * 9/1969 Maxwell ..... F25D 17/065 62/419
3,475,920 A * 11/1969 Jacobs ..... F25D 23/068 62/273
3,572,049 A * 3/1971 Moorman ..... F25D 27/00 62/132
3,599,442 A 8/1971 Hanson
3,845,637 A * 11/1974 Shepherd ..... F25D 21/02 62/155
4,086,785 A 5/1978 Kochendorfer et al.
5,819,552 A * 10/1998 Lee ..... F25D 17/065 62/407
6,199,400 B1 3/2001 Banicevic
6,209,342 B1 * 4/2001 Banicevic ..... F25D 17/067 312/407
9,328,951 B2 5/2016 Shin
9,671,149 B2 6/2017 Kim
2003/0155107 A1 * 8/2003 Bianco ..... F28F 9/0265 165/124
2005/0217307 A1 * 10/2005 Kim ..... F25D 23/061 62/408
2008/0163635 A1 * 7/2008 Friedmann ..... F25D 21/04 62/276
2009/0113924 A1 * 5/2009 Bae ..... F25D 17/065 62/447
2010/0162747 A1 * 7/2010 Hamel ..... F25D 17/065 62/441
2010/0218925 A1 * 9/2010 Candeo ..... F28F 9/002 165/181
2011/0011106 A1 * 1/2011 Ahn ..... F25D 17/065 62/89
2011/0011118 A1 * 1/2011 Cho ..... F25D 17/065 62/419
2012/0042683 A1 2/2012 Malisi
2012/0096887 A1 * 4/2012 Cho ..... F25D 21/08 62/276
2013/0126136 A1 5/2013 Hwang et al.
2016/0370105 A1 * 12/2016 Park ..... F25D 25/025
2017/0059224 A1 3/2017 Bae
2017/0198961 A1 7/2017 Jung

FOREIGN PATENT DOCUMENTS

DE 10 2009 003 263 11/2010
DE 10 2011 090 175 7/2013
EP 2 694 894 2/2014
KR 10-2004-0084280 10/2004
KR 10-2007-0107403 11/2007
KR 10-2013-0048475 5/2013
KR 10-2013-0055243 5/2013
WO WO 2011/007959 1/2011
WO WO 2011/007971 1/2011
WO WO 2012/136532 10/2012
WO WO 2013/098110 7/2013

OTHER PUBLICATIONS

European Search Report dated Jun. 26, 2018 issued in EP Application No. 18153145.0.
Korean Office Action dated Sep. 10, 2021 issued in KR Application No. 10-2021-0102632.
Korean Office Action dated Jan. 2, 2022 issued in KR Application No. 10-2021-0102632.

* cited by examiner

REFRIGERATOR

CROSS-REFERENCE TO RELATED APPLICATION(S)

This application is a Continuation of U.S. application Ser. No. 15/868,180, filed Jan. 11, 2018, which claims priority under 35 U.S.C. 119 and 35 U.S.C. 365 to Korean Patent Application No. 10-2017-0030598 filed on Mar. 10, 2017 in Korea, the entire contents of which are hereby incorporated by reference.

BACKGROUND

1. Field

The present disclosure relates to a refrigerator.

2. Background

A refrigerator may include a plurality of storage chambers in which stored goods are accommodated such that food is stored in a frozen state or a refrigerated state, and surfaces of the storage chambers are opened such that the food is accommodated and withdrawn. The plurality of storage chambers may include a freezer compartment configured to store food in a frozen state and a refrigerator compartment configured to store food in a refrigerated state.

A refrigeration system in which a refrigerant circulates may be operated in the refrigerator. Devices constituting the refrigeration system may include a compressor, a condenser, an expansion device, and an evaporator. The refrigerant may be evaporated while passing through the evaporator, and in this process, air passing through the vicinity of the evaporator may be cooled. Further, the cooled cold air may be supplied to the freezer compartment or the refrigerator compartment. The evaporator may be installed at a rear side of the storage chambers and may extend vertically.

In recent years, enlarging of an inner storage space, e.g., the storage chambers, of the refrigerator is a main concern of consumers. Thus, there have been a large number of efforts to reduce a space accommodating components of the refrigeration system required in the refrigerator and to relatively increase the volumes of the storage chambers. However, as described above, when the evaporator is provided on the rear side of the storage chambers, there may be a difficulty in that the sizes of the storage chambers should be reduced to secure a space for installation of the evaporator.

In particular, the refrigerator may include drawers that may be withdrawn forward from the storage chambers. Thus, as the sizes, or the front-rear lengths of the storage chambers are reduced due to arrangement of the evaporator, the front-rear lengths of the drawers may also be reduced, and accordingly, the withdrawal distances of the drawers may be reduced. There is a problem in that when the withdrawal distances of the drawers are reduced, it may be inconvenient for a user to accommodate food in the drawers.

To solve the above-described problems, a technology of installing the evaporator in a partition wall by which the refrigerator compartment and the freezer compartment are partitioned has been developed. Meanwhile, in a side-by-side refrigerator in which a freezer compartment and a refrigerator compartment are arranged on left and right sides of the refrigerator, because a partition wall vertically extends between the freezer compartment and the refrigerator compartment, defrosting water generated by the evaporator may be easily discharged.

However, in a refrigerator in which a refrigerator compartment and a freezer compartment are arranged on upper and lower sides of the refrigerator, because a partition wall transversely extends between the freezer compartment and the refrigerator compartment, it is difficult to discharge defrosting water generated by an evaporator. Information on the related art related thereto will be described below with reference to Registration Number (Registration date): EP 2,694,894 (Mar. 23, 2016), Title of the invention: COMBINATION DEVICE FOR REFRIGERATION.

The related art discloses a technology of installing an evaporator in a partition wall by which a refrigerator compartment and a freezer compartment are separated from each other, in a refrigerator in which the refrigerator compartment is located on an upper portion of the refrigerator and the freezer compartment is located at a lower portion of the refrigerator. However, the evaporator according to the related art is inclined downward as it goes rearward. Such arrangement of the evaporator allows for defrosting water generated by the evaporator to be easily discharged to a lower side. However, because the evaporator is inclined as it goes rearwards, the thickness of the partition wall for arranging an insulator and the evaporator may be increased. There is a problem in that when the thickness of the partition wall is increased, storage chambers of the refrigerator become relatively smaller.

Further, a lower surface of the partition wall is inclined downward due to the inclined arrangement of the evaporator, and correspondingly, a side surface of a drawer provided at an upper portion of the freezer compartment is inclined downward toward a rear of the refrigerator. In this case, there is a problem in that storage ability for food deteriorates.

Further, according to the arrangement of the evaporator according to the related art, there is a problem in that because a fan is located right behind the evaporator, the defrosting water generated by the evaporator flows into the fan, and thus malfunction of the fan may be caused. Further, when cold air having high humidity passes through the fan, a condensate may be generated in the fan. According to the related art, a separate water passage for discharging the condensate of the fan is not provided, and the condensate flows to a duct to which the cold air is supplied. In this case, there is a problem in that frost caused by the condensate is generated in the duct.

Meanwhile, a tray collecting the defrosting water must be provided on a lower side of the evaporator. According to the arrangement of the evaporator according the related art, to decrease the thickness of the partition wall as much as possible, the tray should be provided on the lower side of the evaporator to be very close to the evaporator. In this case, because the defrosting water stored in the tray is frosted, heat exchange performance of the evaporator deteriorates.

BRIEF DESCRIPTION OF THE DRAWINGS

Embodiments will be described in detail with reference to the following drawings in which like reference numerals refer to like elements, and wherein.

DETAILED DESCRIPTION

Figure 1:
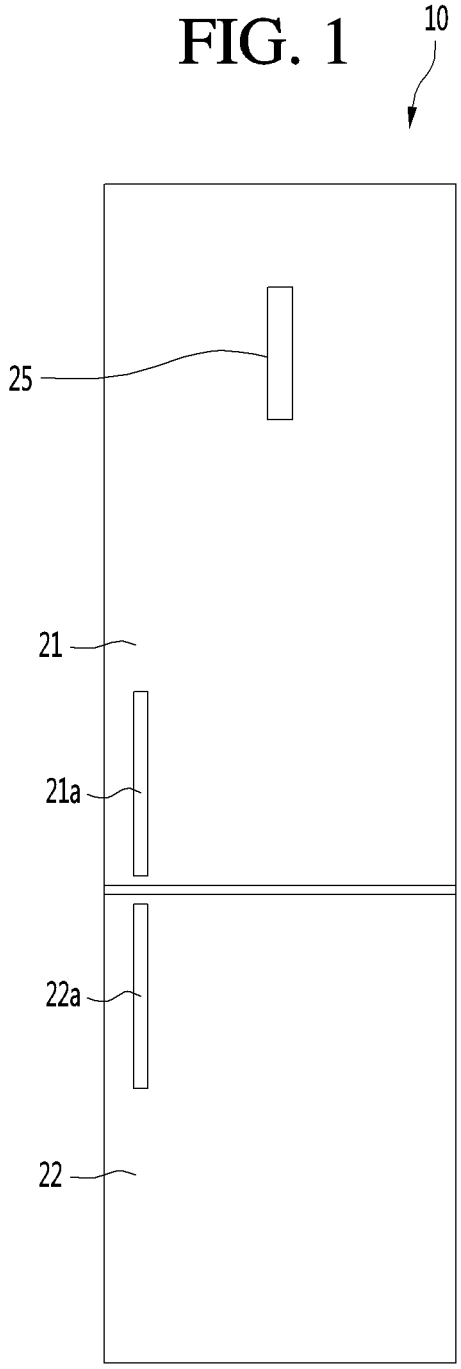
FIG. 1 is a front view illustrating a configuration of a refrigerator according to an embodiment of the present disclosure.
Figure 2:
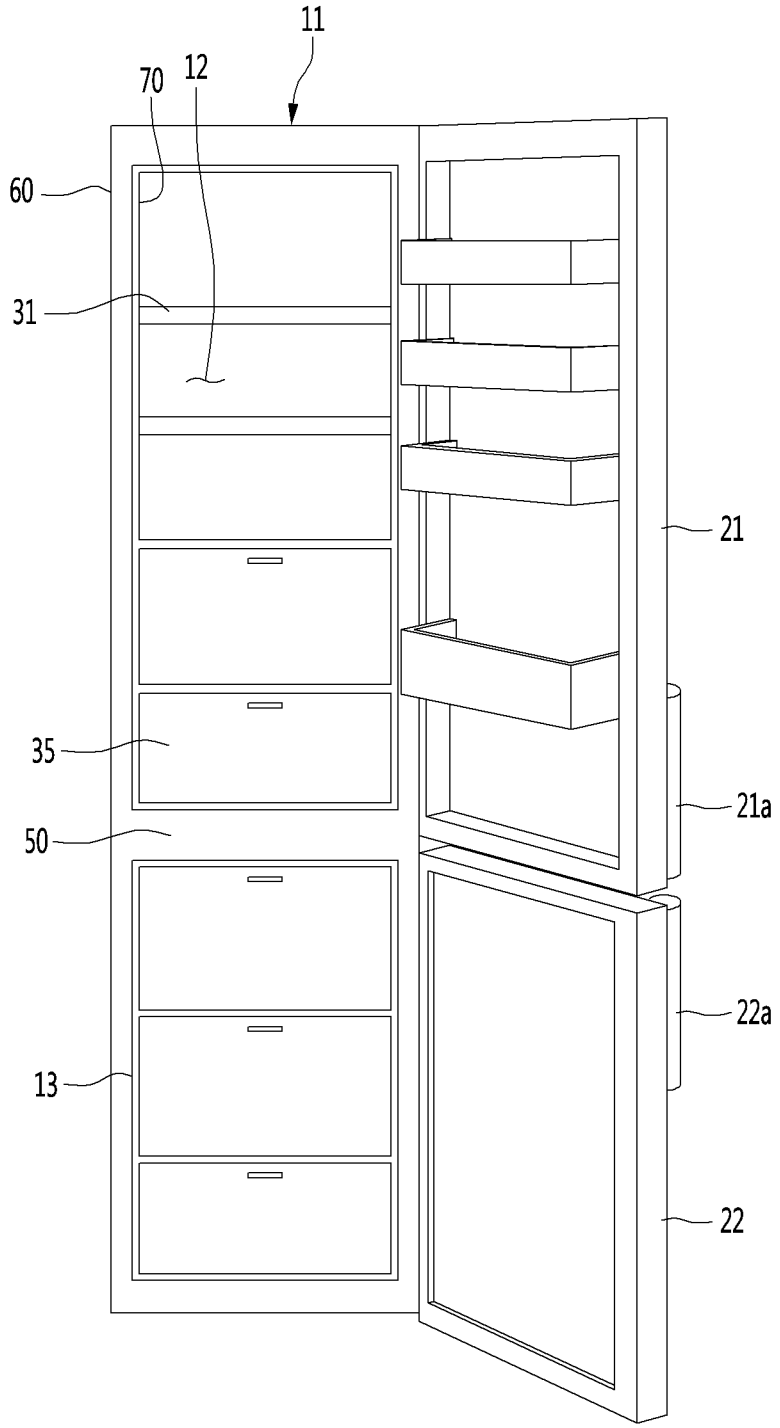
FIG. 2 is a front view illustrating the refrigerator having opened doors according to the embodiment of the present disclosure.
Figure 3:
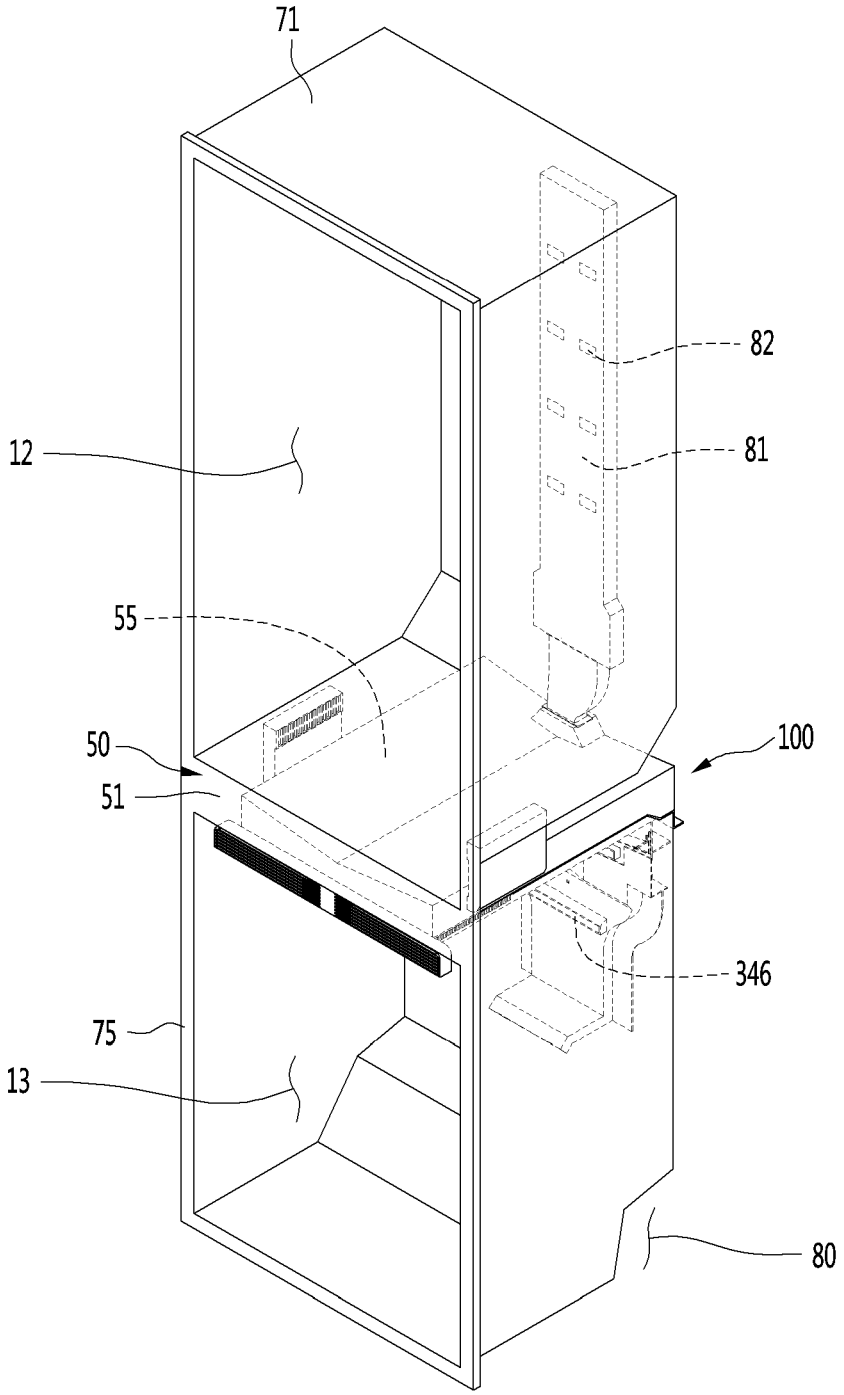
FIG. 3 illustrates an inner case and a cold air supplying device provided in the refrigerator according to the embodiment of the present disclosure.

Referring to FIGS. 1 to 3, a refrigerator 10 according to the embodiment of the present disclosure may include a cabinet 11 in which a storage chamber is provided and doors 21 and 22 provided on a front surface of the cabinet 11 to selectively open/close the storage chamber. The cabinet 11 may have a rectangular parallelepiped shape having an opened front surface. Further, the cabinet 11 may include an outer case 60 defining an outer appearance of the refrigerator and an inner case 70 coupled to an inside of the outer case 60 and defining an inner surface of the storage chamber. A cabinet insulator 65 (see FIG. 23) configured to perform insulation between an outside of the refrigerator and the storage chamber may be provided between the outer case 60 and the inner case 70.

The storage chamber may include first and second storage chambers 12 and 13 controlled at different temperatures. The first storage chamber 12 may include a refrigerator compartment 12, and the second storage chamber 13 may include a freezer compartment 13. As an example, the refrigerator compartment 12 may be formed at an upper portion of the cabinet 11 and the freezer compartment 13 may be formed at a lower portion of the cabinet 11.

In other words, the refrigerator compartment 12 may be arranged above the freezer compartment 13. According to such a configuration, because the refrigerator compartment 12 relatively frequently used to store or withdraw food may be arranged at a height corresponding to a waist of a user, the user does not need to bend his/her waist when the refrigerator compartment 12 is used, so that convenience may be improved.

The refrigerator 10 may further include a partition wall 50 by which the refrigerator compartment 12 and the freezer compartment 13 are partitioned. The partition wall 50 may extend from a front toward a rear of the cabinet 11. As an example, the partition wall 50 may extend from the front toward the rear of the cabinet 11 in a direction that is perpendicular to the ground.

The doors 21 and 22 may include a refrigerator compartment door 21 rotatably provided on a front side of the refrigerator compartment 12 and a freezer compartment door 22 rotatably provided on a front side of the freezer compartment 13. As another example, the freezer compartment door 22 may be a drawer door configured to be withdrawn in a forward direction.

A first handle 21*a* which the user may grip may be provided on a front surface of the refrigerator compartment door 21, and a second handle 22*a* may be provided on a front surface of the freezer compartment door 22. Further, the refrigerator 10 may include a plurality of shelves 31 provided in the storage chambers to accommodate food. As an example, the plurality of shelves 31 may be provided in the refrigerator compartment 12 to be vertically spaced apart from each other.

The refrigerator 10 may further include drawers 35 configured to be withdrawn in a forward direction from the storage chamber. The drawers 35 may be provided in the refrigerator compartment 12 and the freezer compartment 13, and may have accommodation spaces for food formed therein. The front-rear lengths of the drawers 35 may be increased as the front-rear widths of the storage chambers are increased, and accordingly, the withdrawal distances of the drawers 35 may be increased.

When the withdrawal distances of the drawers 35 are increased, convenience for the user to accommodate food may be improved. Thus, in order to improve a user's convenience, the refrigerator may be configured such that the front-rear widths of the storage chambers become relatively larger.

A direction in which the drawers 35 are withdrawn is defined as a forward direction, and a direction in which the drawers 35 are accommodated is defined as a rearward direction. Further, a first or leftward direction when the refrigerator 10 is viewed from the front side of the refrigerator 10 is defined as a first or leftward direction, and a second or rightward direction when the refrigerator 10 is viewed from the front side of the refrigerator 10 is defined as a second or rightward direction. The definition of the directions may be identically applied throughout the specification.

The refrigerator 10 may further include a display unit or display 25 configured to display information on the temperatures and operating states of the storage chambers of the refrigerator. As an example, the display 25 may be provided on the front surface of the refrigerator compartment door 21.

The inner case 70 may include an inner refrigerator compartment case 71 defining the refrigerator compartment 12. The inner refrigerating compartment case 71 may have an opened front surface and may have an approximately rectangular parallelepiped shape.

The inner case 70 may further include an inner freezer compartment case 75 defining the freezer compartment 12. The inner freezer compartment case 75 may have an opened front surface and may have an approximately rectangular parallelepiped shape. The inner freezer compartment case 75 may be arranged below the inner refrigerator compartment case 71 to be spaced apart from the inner refrigerator compartment case 71. The inner refrigerator compartment case 71 may be named a "first inner case", and the inner freezer compartment case 75 may be named a "second inner case".

The partition wall 50 may be arranged between the inner refrigerator compartment case 71 and the inner freezer compartment case 75. The partition wall 50 may include a front partition wall part or surface 51 defining a front outer appearance of the partition wall 50. When the doors 21 and 22 are opened, the front partition wall surface 51 may be located between the refrigerator compartment 12 and the freezer compartment 13 when viewed from the outside.

Because the temperatures of the refrigerator compartment 12 and the freezer compartment 13 are different from each other, the partition wall 50 may further include a partition wall insulator 55 provided on a rear side of the front partition wall surface 51 to insulate the refrigerator compartment 12 and the freezer compartment 13 from each other. The partition wall insulator 55 may be arranged between the bottom surface of the inner refrigerator compartment case 71 and the upper surface of the inner freezer compartment case 75. It may be understood that the partition wall 50 includes the bottom surface of the inner refrigerator compartment case 71, the partition wall insulator 55, and the upper surface of the inner freezer compartment case 75.

The refrigerator 10 may include a cold air supplying device (or cold air supply) 100 configured to supply cold air to the refrigerator compartment 12 and the freezer compartment 13. The cold air supply 100 may be arranged below the partition wall insulator 55. In detail, the cold air supply 100 may be installed on an inner upper surface of the inner freezer compartment case 75.

The cold air generated by the cold air supply 100 may be supplied to the refrigerator compartment 12 and the freezer compartment 13, respectively. A refrigerator compartment cold air duct 81 through which at least a portion of the cold air generated by the cold air supply 100 flows may be provided on a rear side of the refrigerator compartment 12. Further, refrigerator compartment cold air supplying parts or ports 82 configured to supply the cold air to the refrigerator compartment 12 may be formed in the refrigerator compartment cold air duct 81. The refrigerator compartment cold air duct 81 may define a rear wall of the refrigerator compartment 12, and the refrigerator compartment cold air supplying ports 82 may be formed on a front surface of the refrigerator compartment cold air duct 81.

The cold air supply 100 may include a freezer compartment cold air supplying part configured to supply at least a portion of the cold air generated by the cold air supply 100 to the freezer compartment 13. The freezer compartment cold air supplying part may include a second supply part or port 346. Descriptions related thereto will be made with reference to the accompanying drawings.

A machine room 80 may be formed on a lower rear side of the inner freezer compartment case 75. A compressor and an evaporator as components constituting a refrigeration cycle may be installed in the machine room 80.

Figure 4:
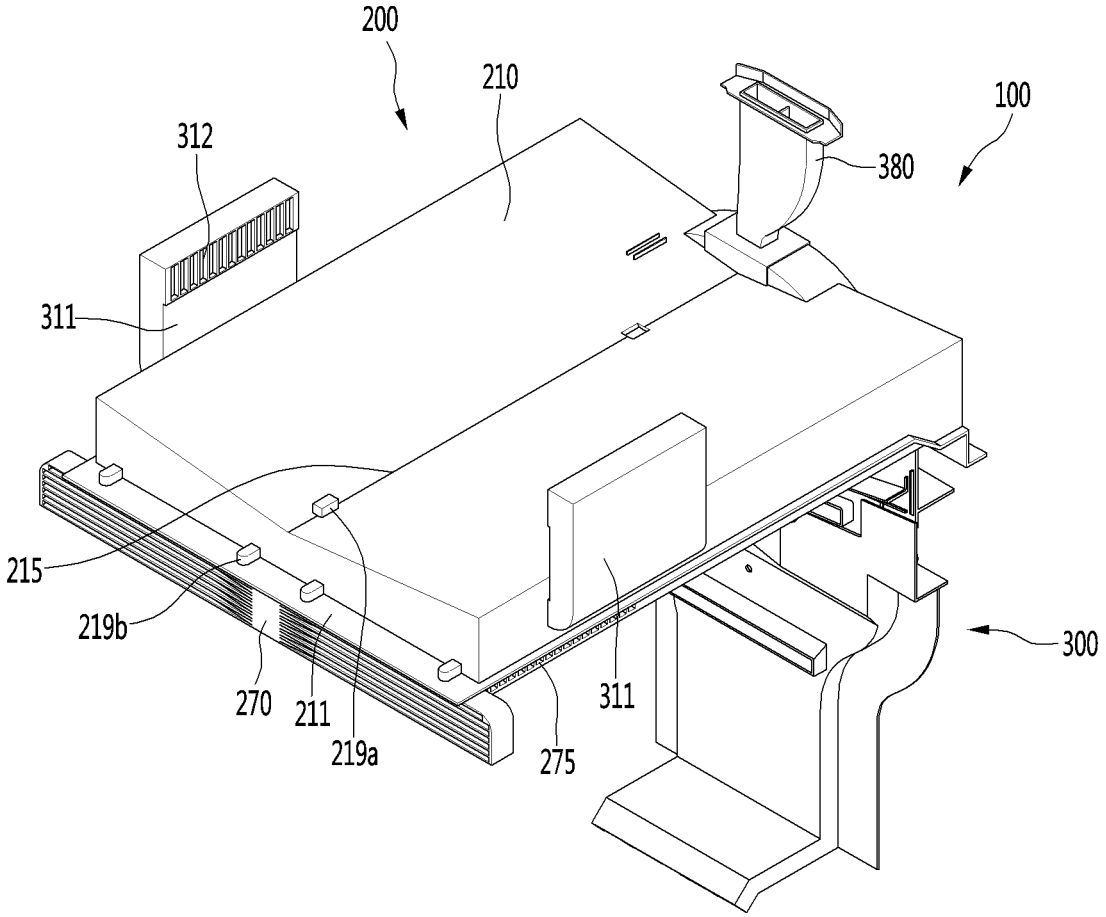
FIG. 4 illustrates a configuration of the cold air supplying device according to the embodiment of the present disclosure.
Figure 5:
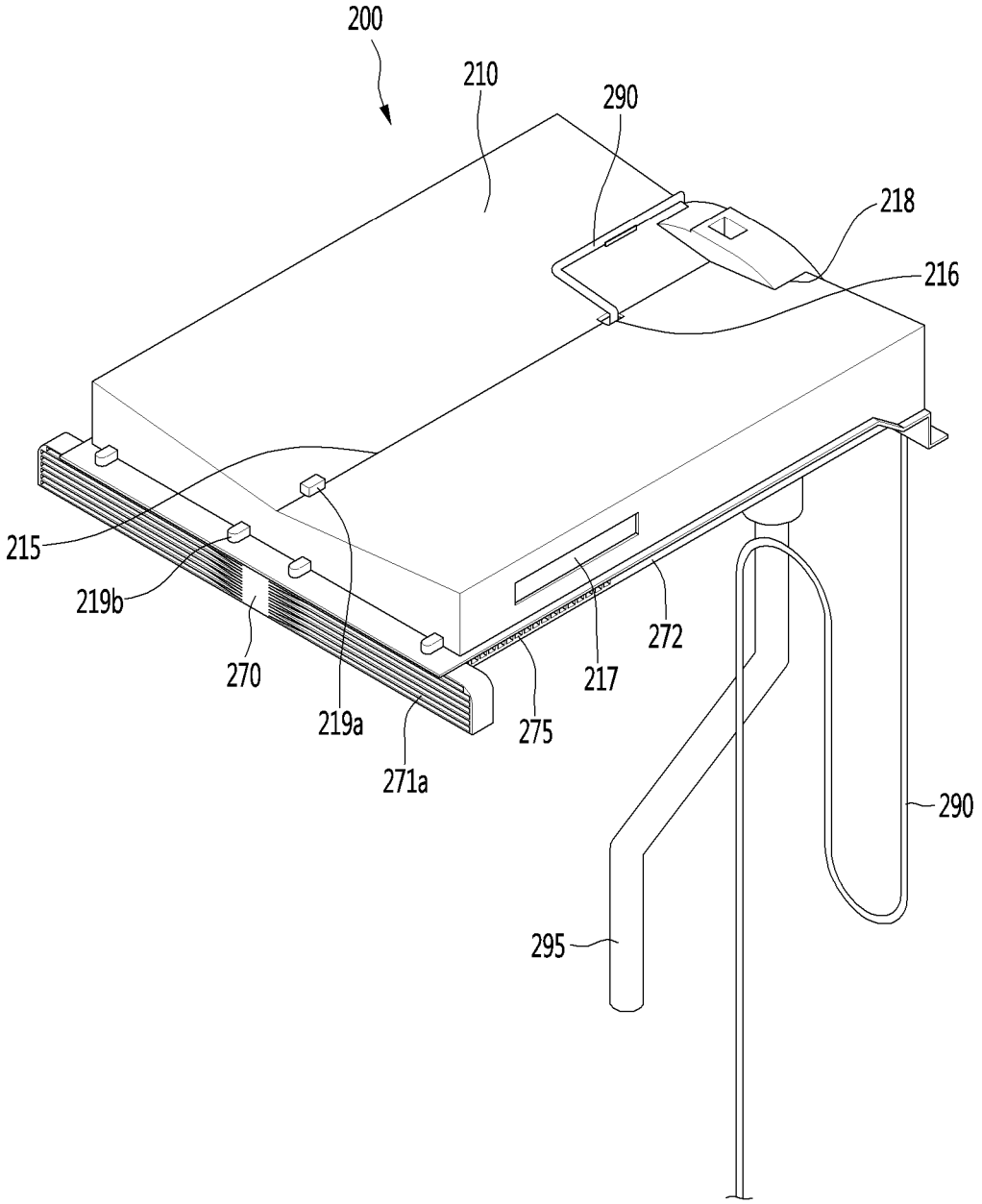
FIG. 5 illustrates a configuration of a cold air generator of the cold air supplying device according to the embodiment of the present disclosure.
Figure 6:
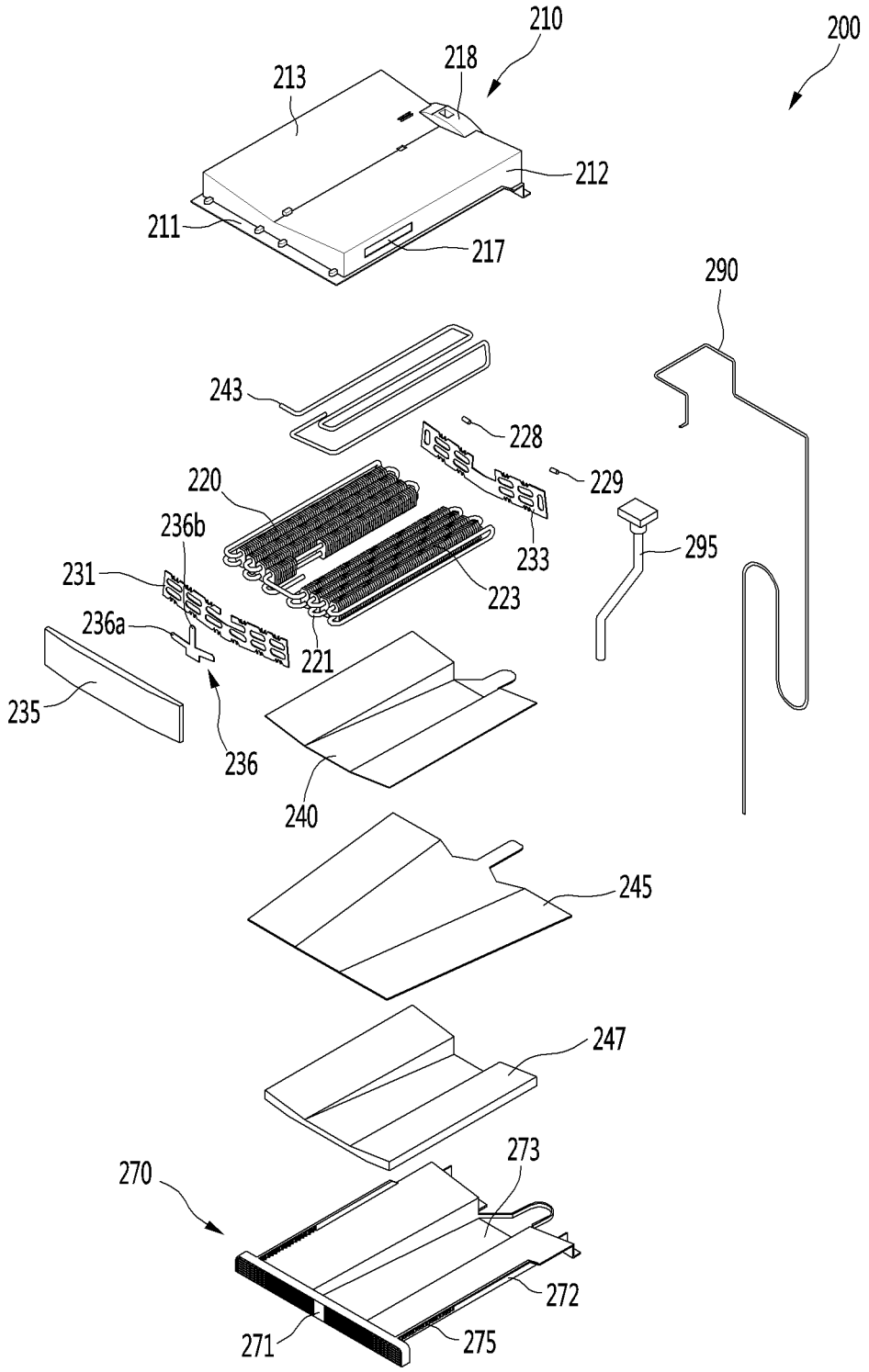
FIG. 6 is an exploded perspective view illustrating the configuration of the cold air generator.

Referring to FIGS. 4 to 6, the cold air supply 100 according to the embodiment of the present disclosure may include a cold air generator 200 configured to generate cold air using the evaporation heat of a refrigerant circulating in the refrigeration cycle and a flow supply part or device 300 configured to supply the cold air generated by the cold air generator 200 to the storage chambers.

The cold air generator 200 may include an evaporator 220 in which the refrigerant is evaporated, a first cover 210 provided above the evaporator 220 and a second cover 270 provided below the evaporator 220. The first cover 210 may be coupled to an upper portion of the second cover 270, and an inner space defined by the first and second covers 210 and 270 may define an installation space in which the evaporator 220 is installed.

The first and second covers 210 and 270 may be named an "evaporator case" or "evaporator casing" accommodating the evaporator 220, and the installation space may be named an "evaporation chamber" or a "heat exchange chamber". The evaporator cases 210 and 270 may be located on the bottom surface of the partition wall 50. The partition wall 50 may insulate the refrigerator compartment 12 from the heat exchange chamber.

The evaporator 220 may include refrigerant pipes 221 through which the refrigerant flows and fins 223 coupled to the refrigerant pipes 221 to increase a heat exchange area for the refrigerant. The first cover 210 may form at least a portion of the inner freezer compartment case 75. In detail, the first cover 210 may form an inner upper surface of the inner freezer compartment case 75.

In other words, the first cover 210 may be formed integrally with the inner freezer compartment case 75. The first cover 210 may include a first front cover part (or first front cover) 211 provided in front of the evaporator 220, first side cover parts (or first side covers) 212 extending rearward from opposite sides of the first front cover 211, and a first upper cover part (or first upper cover) 213 coupled to upper sides of the opposite first side covers 212.

A recessed part (or recess) 215 may be formed at a center of the first upper cover 213. The recess 215 may extend from a front side to a rear side of the first upper cover 213. The first upper cover 213 may be inclined upward from the recess 215 to opposite left and right sides. Such a shape may correspond to a shape of the evaporator 220, which may be inclined in a left-right direction.

Each of the first side covers 212 may include a first duct coupling part (or first duct coupler) 217 to which a discharge duct 311 of the flow supply device 300, which will be described below, is coupled. As an example, the first duct couplers 217 may be formed in the opposite first side covers 212, respectively. That is, the first duct couplers 217 may be arranged on opposite surfaces (a left surface and a right surface) of the first cover 210.

The cold air stored in the refrigerator compartment 12 may be discharged through the discharge ducts 311, and the discharged cold air may flow to the inner space defined by the first cover 210 and the second cover 270 via the first duct coupling parts 217. Further, the cold air may be cooled while passing through the evaporator 220.

The first cover 210 may include a grill cover coupling part (or grill cover coupler) 218 to which first and second grill covers 320 and 330 of the flow supply device 300, which will be described below, are coupled. As an example, the grill cover coupler 218 may be vertically penetrated, and upper portions of the first and second grill covers 320 and 330 may be inserted into the grill cover coupler 218. At least a portion of the cold air generated by the evaporator 220 may flow to a first supply duct 380 and may be supplied to the refrigerator compartment 12. The grill cover coupler 218 may be formed in the first upper cover 213.

A pipe penetration part or hole 216 through which a suction pipe 290 passes may be formed in the first cover 210. The suction pipe 290 may be a pipe configured to guide the refrigerant evaporated by the evaporator 220 to the compressor. The suction pipe 290 may extend from the gas-liquid separator 260, may pass through the pipe penetration hole 216, and may extend to the compressor arranged in the machine room 80. The pipe penetration hole 216 may be formed in the recess 215.

The second cover 270, which supports the evaporator 220, may be arranged in the freezer compartment 13. As an example, the second cover 270 may be arranged on a lower side of the inner freezer compartment case 75. The second cover 270 may include a cover seating part (or cover seat) 273 arranged on a lower side of the evaporator 220 to support the evaporator 220 or a defrosting water tray 240. The cover seat 273 may be inclined downward, that is, to be recessed, from opposite left and right sides toward a central side, to correspond to the inclined shape of the evaporator 220 and the inclined shape of the defrosting water tray 240.

The second cover 270 may further include a second front cover part (or second front cover) 271 provided in front of the cover seat 273. Through-holes 271*a* (see FIG. 5) through which the cold air stored in the freezer compartment 13 may pass may be formed in the second front cover 271. As an example, the through-holes 271*a* may be formed on opposite sides of the second front cover 271 to guide the cold air located on a front side of the freezer compartment 13 such that the cold air may easily flow to cover discharge holes 275. By the formation of the through-holes 271*a*, flow resistance of the cold air flowing toward the cover discharge holes 275 may be reduced.

The second cover 270 may further include second side cover parts (or second side covers) 272 coupled to opposite sides of the second front cover 271 to extend rearward. Further, the opposite second side covers 272 may be coupled to opposite sides of the cover seat 273 to extend upward. The first cover 210 may be coupled to upper portions of the second side covers 272.

The cover discharge holes 275 configured to guide the cold air stored in the freezer compartment 13 to the evaporator 220 may be formed in the second side covers 272. As an example, a plurality of holes may be included in the cover discharge holes 275, and the plurality of holes may be arranged from front sides toward rear sides of the second side covers 272. The cold air in the freezer compartment 13 may flow to the inner space defined by the first and second covers 210 and 270 through the cover discharge holes 275 and may be cooled while passing through the evaporator 220.

The cold air generator 200 may further include a first heater 243 coupled to the evaporator 220 to supply a predetermined amount of heat to the evaporator 220. The first heater 243, which may be a heater configured to provide an amount of heat to melt ice when frost occurs in the evaporator 220, may be named a "first defrosting heater". As an example, the first heater 243 may be coupled to an upper portion of the evaporator 220.

Figure 9:
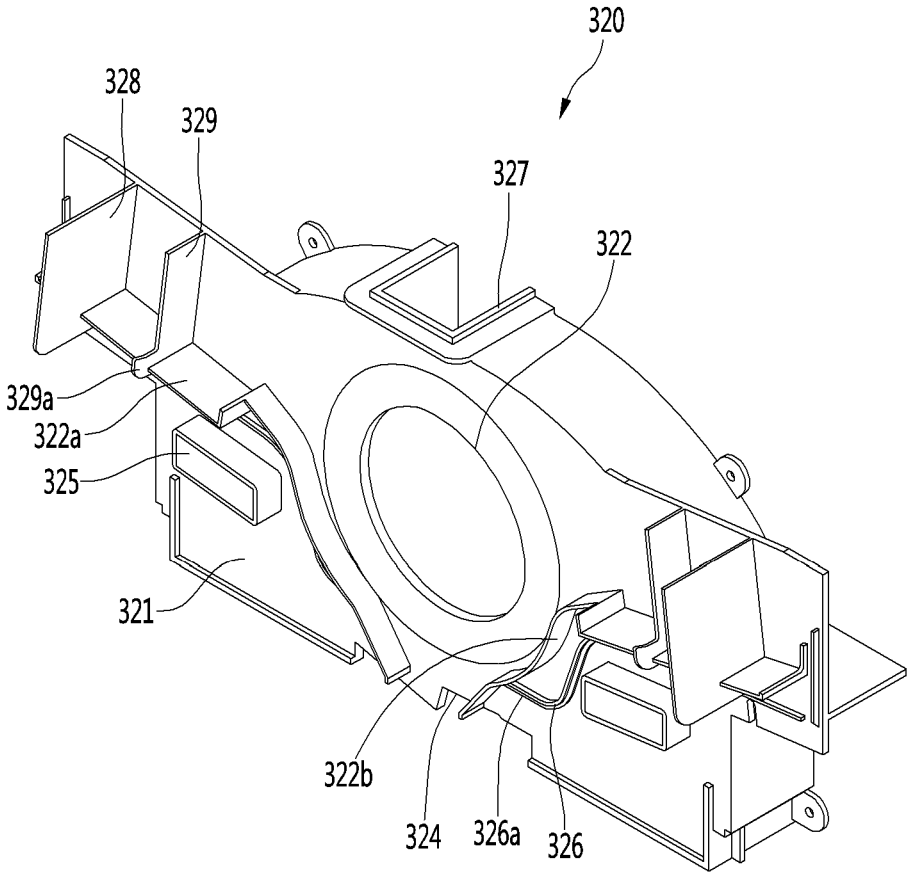
FIG. 9 is a perspective view illustrating a configuration of a first grill cover according to the embodiment of the present disclosure.
Figure 10:
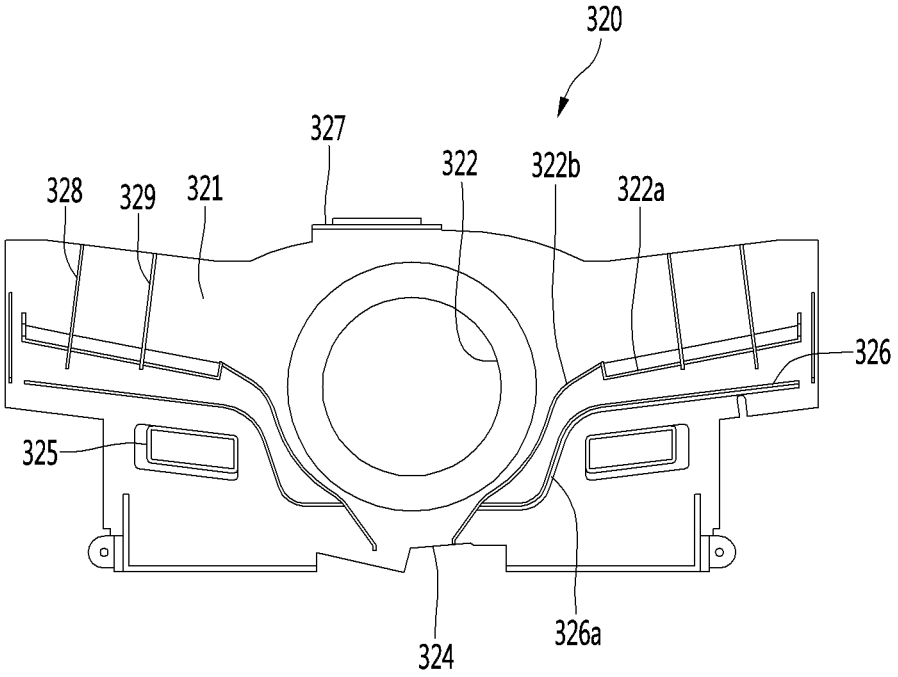
FIG. 10 is a front view illustrating the configuration of the first grill cover according to the embodiment of the present disclosure.
Figure 11:
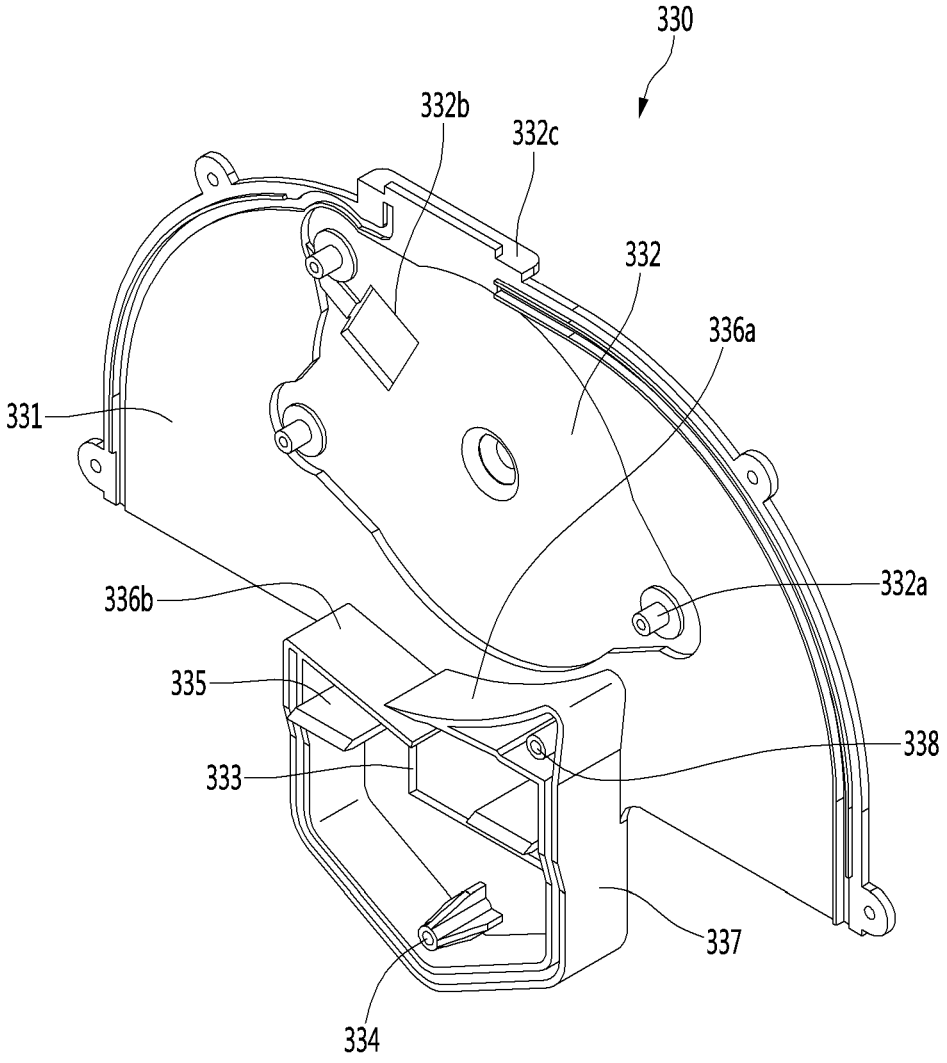
FIG. 11 is a perspective view illustrating a configuration of a second grill cover according to the embodiment of the present disclosure.

The cold air generator 200 may further include evaporator supporting devices (or evaporator supports) 231, 233, 236 and 329 configured to support the evaporator 220. The evaporator supports 231, 233, 236, and 329 may be located inside the evaporator cases 210 and 270. Further, the evaporator supports 231, 233, 236, and 329 may include evaporator holders 231 and 233, a hook device or hook 236, and support guides 329 (see FIG. 9).

The evaporator holders 231 and 233 may include a first holder 231 supporting a front portion of the evaporator 220 and a second holder 233 supporting a rear portion of the evaporator 220. The first holder 231 may be located on the front upper side of the defrosting water tray 240 and the second holder 233 may be located on the rear upper side of the defrosting water tray 240.

The hook 236 may be provided in the first holder 231 to support the evaporator 220. As an example, the hook 236 may be arranged on the front surface of the first holder 231 to support the refrigerant pipes 221 of the evaporator 220. The hook 236 may include second pipe supports 236*a* supporting bent pipes of the refrigerant pipes 221, which protrude to the front side of the first holder 231, and a cover coupling part (or cover coupler) 236*b* protruding upward from the second pipe support 236*a* and coupled to the first cover 210. The plurality of second pipe supports 236*a* may be provided on opposite sides of the hook 236 to support the plurality of bent pipes.

The first cover 210 may include a hook coupling part (or hook coupler) 219*a* to which the cover coupler 236*b* is coupled. The hook coupler 219*a* may be provided in the upper cover 213. The cover coupler 236*b* may protrude upward from the upper cover 213 to be caught by the hook coupler 219*a*. As an example, the hook coupler 219*a* may be provided in the recess 215.

The support guides 329 may be provided in the first grill cover 320. As an example, the support guides 329 may protrude forward from the front surface of the first grill cover 320 to support the refrigerant pipes 221 of the evaporator 220. The support guides 329 may include a first pipe support 329*a* supporting bent portions of the refrigerant pipes 221, which protrude to the rear side of the second holder 233. The first pipe support 329*a* may be provided below the support guides 329, may have a downward recessed shape, and may stably support the bent pipes.

Further, the plurality of support guides 329 may be provided on opposite sides of the first grill cover 320. Thus, a plurality of heat exchangers 220*a* and 220*b* may be stably supported by the plurality of support guides 329.

The first and second covers 210 and 270 may be coupled to each other. A cover fixing part or boss 219*b* to which a screw is fastened may be provided in the first front cover 211 of the first cover 210. The screw may be coupled to the cover fixing boss 219*b*, may extend downward, and may be fastened to an upper portion of the second front cover 271 of the second cover 270. As an example, the cover fixing boss 219*b* may be provided in plurality, and the plurality of cover fixing bosses 219*b* may be transversely spaced apart from each other. According to such a structure, the front portions of the first and second covers 210 and 270 may be stably coupled.

The cold air generator 200 may further include a defrosting sensor 228 configured to detect the temperature near the evaporator 220 to determine a defrosting start time or a defrosting termination time of the evaporator 220. The defrosting sensor 228 may be installed in the evaporator holders 231 and 233, for example, the second holder 233.

The cold air generator 200 may further include a fuse 229 configured to interrupt a current applied to the first heater 243. When the temperature of the evaporator 220 is not less than a predetermined temperature, the fuse 229 may be cut to interrupt the current supplied to the first heater 243, so that a safety accident may be prevented. The fuse 229 may be installed in the evaporator holders 231 and 233, for example, the second holder 233.

The cold air generator 220 may further include evaporator insulators 235 and 247 configured to perform insulation between the heat exchange area formed near the evaporator 220 and a space outside the heat exchange area. In detail, the evaporator insulators 235 and 247 may include a cover insulator 235 arranged on a front side of the first holder 231 to insulate a front space of the evaporator 220. Further, the cover insulator 235 may be inserted into an insulator inserting part or slot 271*b* formed in the second front cover 271 of the second cover 270.

The evaporator insulators 235 and 247 may include a tray insulator 247 supported by the second cover 270. The tray insulator 247 may be arranged below the defrosting water tray 240 to insulate a lower space of the evaporator 220. The tray insulator 247 may be seated on the cover seat 273 of the second cover 270 and may be positioned below the second heater 245. In particular, the tray insulator 247 may prevent heat generated by the second heater 245 from being applied to the freezer compartment 13.

The cold air generator 220 may further include the defrosting water tray 240 arranged below the evaporator 220 to collect the defrosting water generated by the evaporator 220. The defrosting water tray 240 may be recessed from opposite sides toward a central portion of the defrosting water tray 240 to correspond to the shape of the evaporator 220. Thus, the defrosting water generated by the evaporator 220 may be stored in the defrosting water tray 240 and may flow to the central portion of the defrosting water tray 240.

In a spaced distance between the defrosting water tray 240 and the evaporator 220, a distance between the evaporator 220 and the central portion of the defrosting water tray 240 may be larger than a distance between the evaporator 220 and the opposite sides of the defrosting water tray 240. In other words, the spaced distance between the defrosting water tray 240 and the evaporator 220 may be gradually increased from opposite sides toward central portions of the evaporator 220 and the defrosting water tray 240. According to such a configuration, even when an amount of the defrosting water flowing to the central portion of the defrosting water tray 240 increases, the defrosting water may not contact with the surface of the evaporator 220, so that the frost in the evaporator 220 may be prevented.

The cold air generator 200 may further include the second heater 245 arranged below the defrosting water tray 240 to supply a predetermined amount of heat to the defrosting water tray 240. The second heater 245, which is a heater configured to provide an amount of heat for melting ice when frost occurs in the defrosting water tray 240, may be named a "second defrosting heater". The second heater 245 may be arranged between the defrosting water tray 240 and the tray insulator 247.

As an example, the second heater 245 may include a surface-shaped heater having a shape of a plate or a panel. The second heater 245 may be provided on the bottom surface of the defrosting water tray 240, and thus the defrosting water flowing through the upper surface of the defrosting water tray 240 may not be disturbed by the second heater 245, so that the defrosting water may be easily discharged. Further, the defrosting water may not be applied to the surface of the second heater 245, so that a phenomenon in which the second heater 245 is corroded or damaged by the defrosting water may be prevented.

The cold air generator 200 may further include a drain pipe 295 configured to discharge the defrosting water collected in the defrosting water tray 240 from the defrosting water tray 240. The drain pipe 295 may be arranged on a rear side of grill covers 320, 330, and 340, which will be described below. Further, the drain pipe 295 may be connected to a rear side of the defrosting water tray 240, extend downward, and communicate with the machine room 80. The defrosting water may flow through the drain pipe 295 to be introduced into the machine room 80, and may be collected in a drain fan provided in the machine room 80.

Figure 7:
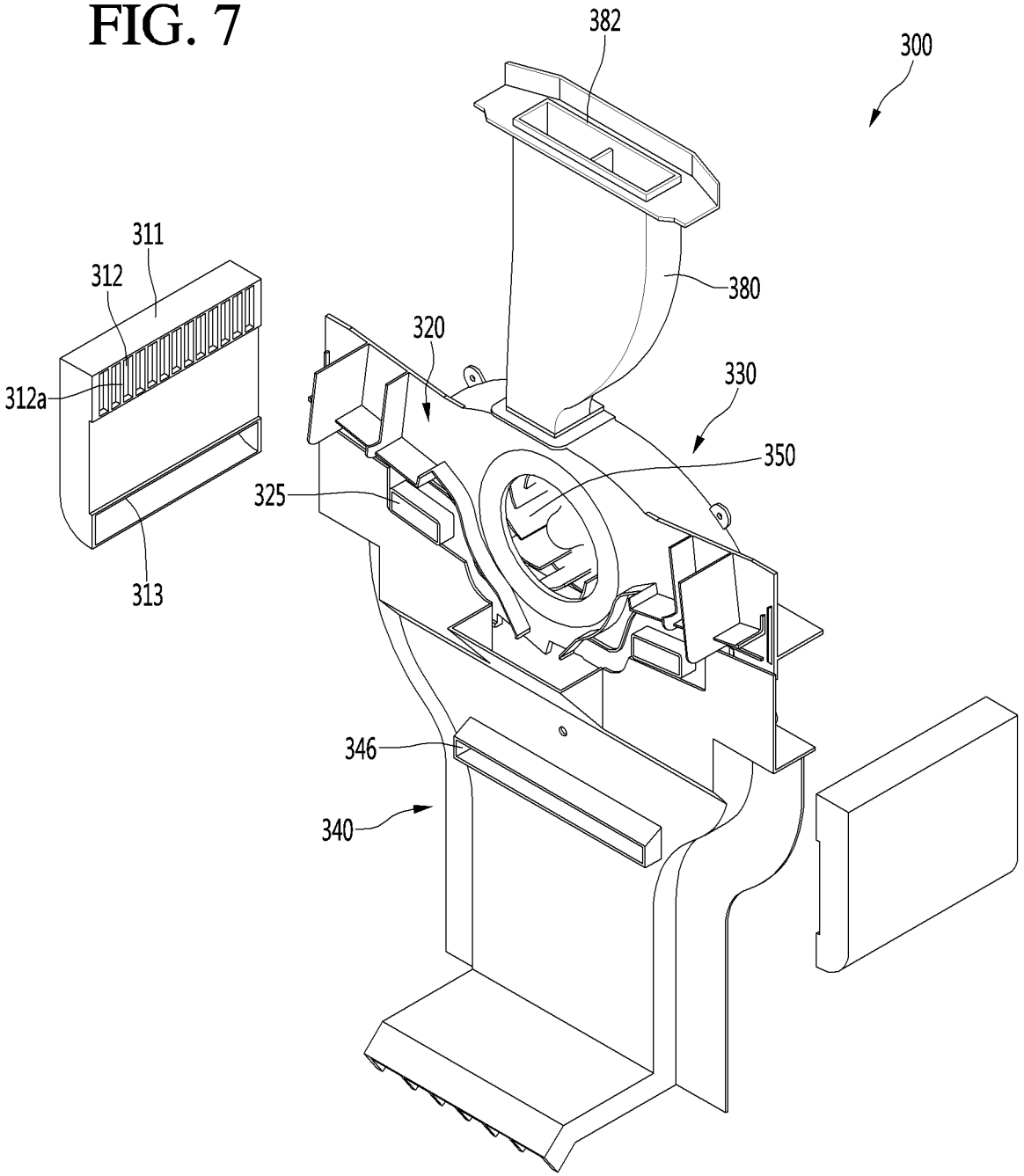
FIG. 7 illustrates a configuration of a flow supply part of the cold air supplying device according to the embodiment of the present disclosure.
Figure 8:
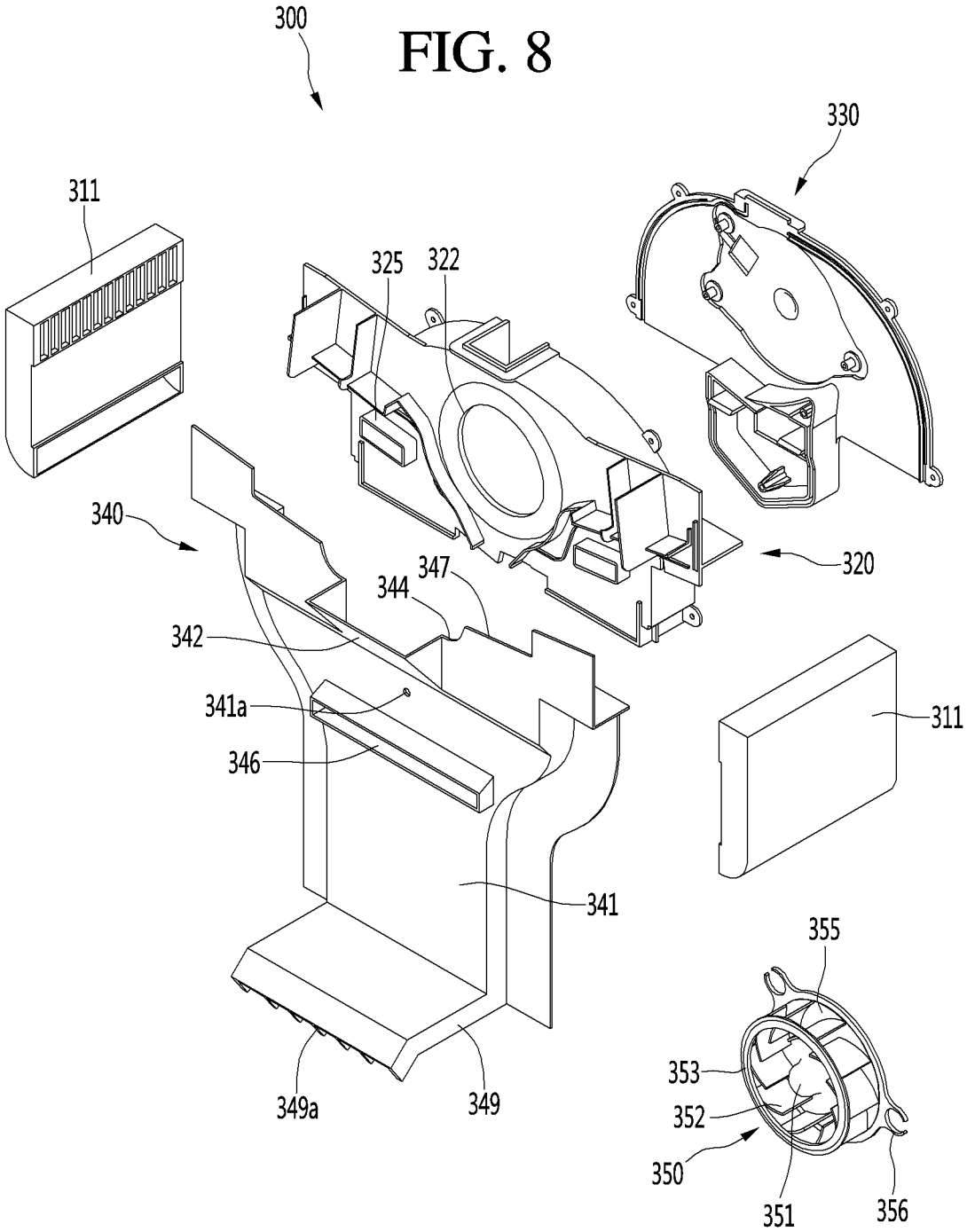
FIG. 8 is an exploded perspective view illustrating the configuration of the flow supply part.

Referring to FIGS. 7 and 8, the flow supply device 300 according to the embodiment of the present disclosure may include fan assemblies 350 and 355 configured to generate a flow of the cold air. The fan assemblies 350 and 355 may include a blower fan 350. As an example, the blower fan 350 may include a centrifugal fan by which the cold air is introduced in an axial direction and is discharged in a circumferential direction. The cold air flowing through a refrigerator compartment suction passage and the cold air flowing through a freezer compartment suction passage may be combined with each other and the combined cold air may be introduced into the blower fan 350.

The blower fan 350 may include a hub 351 to which a fan motor is coupled, a plurality of blades 352 arranged on an outer peripheral surface of the hub 351, and a bell mouth 353 coupled to front ends of the plurality of blades 352 to guide the cold air such that the cold air is introduced into the blower fan 350. The blower fan 350 may be installed in an inner space between the first and second grill covers 320 and 330. The blower fan 350 may be seated on a fan seating part (or fan seat) 332 provided in the grill covers 320 and 330. The fan seat 332 may be provided in the second grill cover 330.

The fan assemblies 350 and 355 may further include a fan support 355 coupled to the blower fan 350 to allow the blower fan 350 to be supported on the grill covers 320 and 330. The fan support 355 may include cover supports 356 coupled to support coupling parts (or support couplers) 332*a* of the fan seat 332. The plurality of cover supports 356 may be formed along a circumference of the fan support 355.

The first and second grill covers 320 and 330 may define an installation space (hereinafter, referred to as a fan installation space) in which the fan assemblies 350 and 355 are installed. The grill covers 320 and 330 may be located on a rear side of the freezer compartment 13, e.g., on the front side of a rear surface of the inner freezer compartment case 75. The grill covers 320 and 330 may include a first grill cover 320 and a second grill cover 330 coupled to a rear side of the first grill cover 320. The installation space may be defined as an inner space formed by coupling the first and second grill covers 320 and 330 to each other.

The first grill cover 320 may include a first grill cover body 321 having a plate shape and a fan suction part or port 322 formed in the first grill cover body 321 to guide the cold air heat-exchanged by the evaporator 220 such that the cold air flows to the blower fan 350. As an example, the fan suction port 322 may be formed at an approximately central portion of the first grill cover body 321 and may have a circular shape. The air passing through the evaporator 220 may be introduced into the fan installing space via the fan suction port 322.

Condensate guides 322*a* and 322*b* configured to guide a condensate generated around the fan suction port 322 or a condensate generated in the evaporator 220 to the lower side may be provided outside the fan suction port 322. Here, the condensate generated around the fan suction port 322 may include a condensate generated in the first and second grill covers 320 and 330 or the blower fan 350.

The condensate guides 322*a* and 322*b* may protrude from a front surface of the first gill cover body 321. The condensate guides 322*a* and 322*b* may include first guides 322*a* extending to be inclined downward from opposite sides of the front surface of the first grill cover body 321 to a central portion of the first grill cover body 321. Thus, the defrosting water existing on the front side of the first grill cover body 321 may be discharged to the central portion of the first grill cover body 321 along the first guides 322*a*.

Further, the first guides 322*a* may extend to be inclined downward from the front surface of the first grill cover body 321 toward the front side. Thus, the defrosting water existing on the front side of the first grill cover body 321 may flow along the first guides 322*a* and may drop to the defrosting water tray 240.

The condensate guides 322*a* and 322*b* may further include second guides 322*b* extending to be inclined downward from opposite sides of the fan suction port 322. The second guides 322*b* may be connected to the first guides 322*a* to extend toward a central portion of the first grill cover body 321. As an example, the second guides 322*b* may be rounded.

The first grill cover 320 may further include blocking parts or walls 328. The blocking walls 328 may be provided on a front surface of the first grill cover body 321 and may act to block air to prevent the air from being directly introduced from opposite rear sides of the evaporator 220 to the fan suction port 322.

At least a portion of the air introduced into the evaporator cases 210 and 270 through the first duct couplers 217 and the cover discharging holes 275 may flow from opposite sides to the rear side of the evaporator 220 without passing through the evaporator 220, and may be suctioned to the fan suction port 322. Thus, the blocking walls 328 may be provided to prevent the air from bypassing the evaporator 220 and being directly suctioned to the fan suction part 322.

The blocking walls 328 may be provided on opposite sides of the front surface of the first grill cover body 321 to protrude forward so as to prevent flow of the air suctioned to the fan suction port 322 along the front surface of the first grill cover body 321. Further, the blocking walls 328 may be stably supported on the upper surfaces of the first guides 322*a*.

The first grill cover 320 may further include mounting guides 326. The mounting guides 326 may guide the second cover 270 such that the second cover 270 is stably supported on the first grill cover 320. The mounting guides 326 may be provided on the front surface of the first grill cover body 321 and support a rear side of the second cover 270.

The mounting guides 326 may protrude forward from the front surface of the first grill cover body 321 and may be spaced apart from upper portions of first supply ports 325. A rear portion of the second cover 270 may be inserted into spaces between the mounting guides 326 and the first supply ports 325 and may be stably supported. Thus, the defrosting water tray 240 supported by the second cover 270 may be also stably supported on the first grill cover 320.

The mounting guides 326 may be inclined or rounded from lower portions of the condensate guides 322*a* and 322*b*. A configuration of the mounting guides 326 may correspond to the shape of the second cover 270. Further, the mounting guides 326 may be provided on opposite sides of the fan suction port 322.

Sealing members (or seals) 326*a* in contact with the second cover 270 may be provided on lower sides of the mounting guides 326. When the second cover 270 is mounted on the front side of the first grill cover 320, the seals 326*a* may come into contact with the rear side of the second cover 270. Accordingly, the second cover 270 may be stably supported, and the defrosting water may be prevented from leaking along a space between the second cover 270 and the mounting guides 326.

A first duct coupling part (or first duct coupler) 327 may be provided in the first grill cover 320. The first duct coupler 327 may be provided at an upper portion of the first grill cover body 321. The first duct coupler 327 may define a "duct coupling part" to which the first supply duct 380 is coupled, together with a second duct coupling part (or second duct coupler) 332*c* of the second grill cover 330. The duct coupling part may have a shape of a coupling hole to communicate with the first supply duct 380.

The first grill cover 320 may include a first recessed part (or first recess) 324 recessed upward from a lower portion of the first grill cover body 321. The first recess 324 may define a first cover inserting part or portion 324, 342, and 344 into which the second cover 270 or the defrosting water tray 240 of the cold air generator 200 is inserted, together with a second recessed part (or second recess) 344 and an insertion guide 342 of the third grill cover 340. The second recess 344 may be recessed downward from an upper portion of the third grill cover 340, and the insertion guide 342 may be provided on a front surface of the third grill cover 340 to protrude forward from the second recessed part 344.

When the third grill cover 340 is coupled to the front side of the first grill cover 320, the first and second recesses 324 and 344 and the insertion guide 342 may be engaged with each other to define the first cover inserting portion 324, 344, and 342. The first cover inserting portion may be understood as an insertion hole of the first and second grill covers 320 and 340.

The second grill cover body 330 may further include a second cover inserting part or hole 333 into which the second cover 270 or the defrosting water tray 240 of the cold air generator 200 is inserted. The second cover 270 or the defrosting water tray 240 may extend to the first and third grill covers 320 and 340 through the first cover inserting portion 324, 344, and 342 and extend to a rear side of the second grill cover 330 through the second cover inserting hole 333. Further, the second cover 270 or the defrosting water tray 240 may be connected to the drain pipe 295 and the defrosting water stored in the defrosting water tray 240 may be introduced into the drain pipe 295 (see FIG. 23).

The third grill cover 340 may be coupled to a front side of the first grill cover 320. Further, the third grill cover 340 may extend to the lower side of the first grill cover 320. The third grill cover 340 may include a third grill cover body 341 having a plate shape, and a fastening hole 341*a* formed in the third grill cover body 341 and coupled to a third grill cover coupling part or boss 334 of the second grill cover 330. A predetermined fastening member may pass through the fastening hole 341*a* of the third grill cover 340 to be coupled to the third grill cover coupling boss 334. The third grill cover coupling boss 334 may include a protrusion rib into which the fastening member may be inserted.

The third grill cover body 341 may further include the insertion guide 342 protruding forward from the third grill cover body 341 and configured to guide the second cover 270 or the defrosting water tray 240 such that the second cover 270 or the defrosting water tray 240 is inserted into the first and third grill cover 320 and 340. Because the insertion guide 342 protrudes forward from the second recess 344, a space through which the second cover 270 or the defrosting water tray 240 may be inserted through the first cover inserting portion 324, 344, and 342 may be sufficiently secured.

The third grill cover body 341 may further include a first grill cover support 347 supporting the first supply ports 325. The first grill cover support 347 may extend the second recess 344 toward the outside of the third grill cover body 341. The first supply ports 325 may protrude from the first grill cover body 321 and may be supported on the upper side of the first grill cover support 347.

The grill covers 320, 330, and 340 may include a plurality of cold air supplying ports 325 and 346 configured to discharge the cold air passing through the blower fan 350 to the freezer compartment 13. In detail, the plurality of cold air supplying ports 325 and 346 may include first supply ports 325 formed in the first grill cover 320. The plurality of first supply ports 325 may be arranged on opposite sides of the fan suction port 322, and may be located above the first cover inserting portion 324, 342, and 344. The first supply ports 325 may supply the cold air toward an upper space of the freezer compartment 13.

As an example, the first supply ports 325 may supply the cold air toward the lower surface of the cold air generator 200, e.g., the bottom surface of the second cover 270. Dew may be generated on an outer surface of the second cover 270 due to a difference between the internal temperature of the second cover 270 and the internal temperature of the freezer compartment 13.

The cold air supplied through the first supply ports 325 may flow toward the second cover 270, so that the dew may be evaporated or the frost existing in the second cover 270 may be removed. To achieve this, the first supply ports 325 may be arranged at locations that are lower than the bottom surface of the second cover 270. Further, the first guides 322*a* may protrude forward and be inclined upward from the front surface of the first grill cover body 321.

The plurality of cold air supplying ports 325 and 346 may include a second supply port 346 formed in the third grill cover 340. The second supply port 346 may be formed at an approximately vertical central portion of the third grill cover 340 and may supply the cold air toward a central space or a lower space of the freezer compartment 13. The third grill cover 340 may be named a "cold air supply duct" in that the third grill cover 340 may extend downward from the first grill cover 320 and supply the cold air to the freezer compartment 13 through the second supply port 346.

The second grill cover 330 may be coupled to a rear side of the first grill cover 320. The second grill cover 330 may include a second grill cover body 331 having a plate shape. The second grill cover body 331 may include the fan seat 332 having the support couplers 332*a* coupled to the fan support 355. The fan seat 332 may be arranged at a position corresponding to the fan suction port 322 of the first grill cover 320. Further, the fan seat 332 may further include a wire penetration hole 332*b* through which an electric wire connected to the blower fan 350 passes.

A first grill cover coupling part or boss 338 coupled to the first grill cover 320 may be provided in the second grill cover body 331. A predetermined fastening member may be coupled to the first grill cover coupling boss 338 to be fastened to a rear surface of the first grill cover 320. Further, the second grill cover body 331 may include a second duct coupling part (or second duct coupler) 332*c* coupled to a rear portion of the first duct coupler 327 of the first grill cover 320. The first and second duct couplers 327 and 332*c* may be coupled to the first supply duct 380.

The second grill cover 330 may further include a coupling guide 337 provided below the second grill cover body 331 and coupled to the first grill cover 320. The coupling guide 337 may protrude forward from the second grill cover body 331 to support the rear surface of the first grill cover 320, and may surround the second cover inserting hole 333.

The third grill cover coupling boss 334 coupled to the third grill cover 340 may be provided at a lower portion of the coupling guide 337. A predetermined fastening member may fasten the third grill cover coupling boss 334 and a fastening hole 341*a* of the third grill cover 340 to each other. Further, the coupling guide 337 may include the second cover inserting hole 333 into which the second cover 270 or the defrosting water tray 240 is inserted. The second cover inserting hole 333 may be formed such that front and rear sides of the coupling guide 337 pass therethrough.

Figure 21:
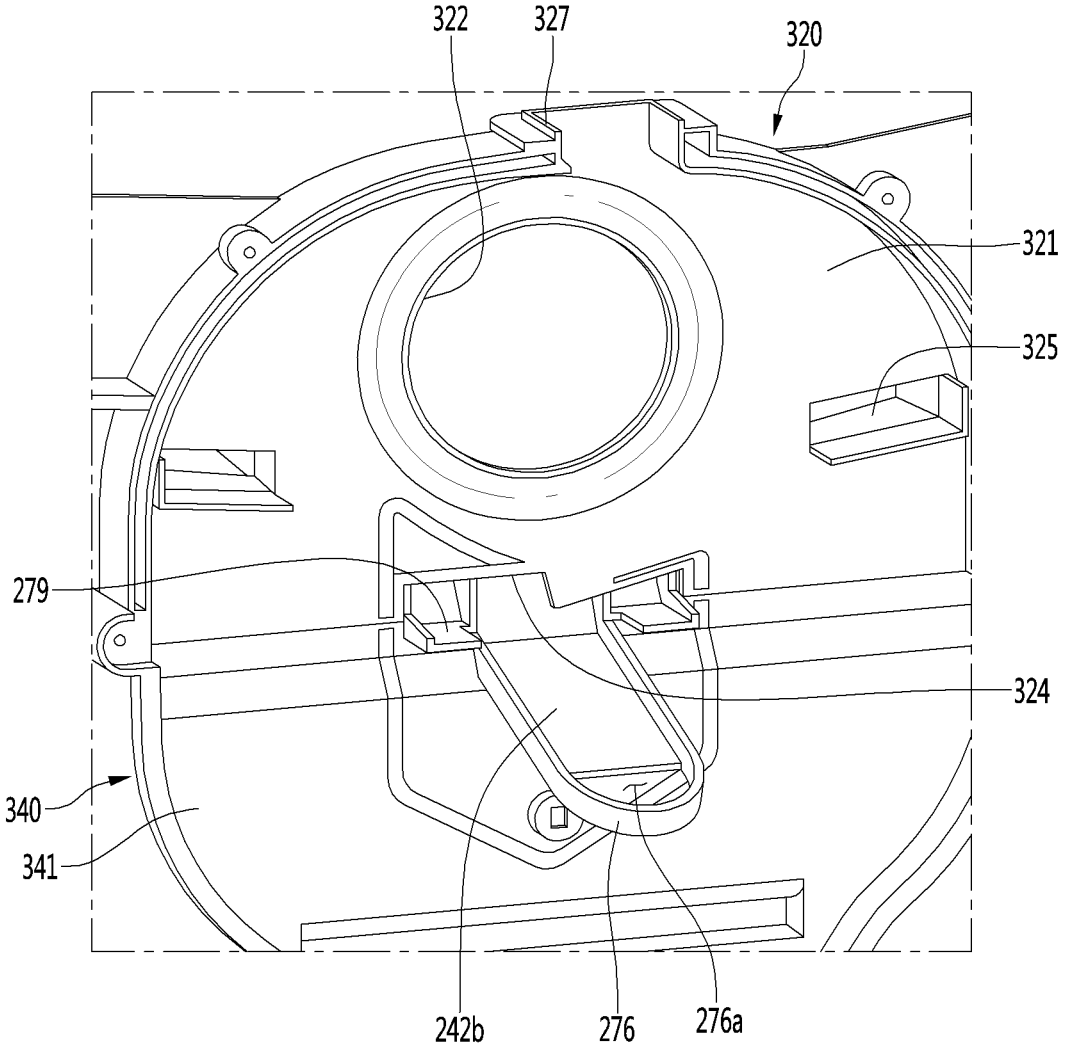
FIG. 21 illustrates a state in which the second cover of the evaporator case is arranged through first and third grill covers according to the embodiment of the present disclosure.
Figure 22:
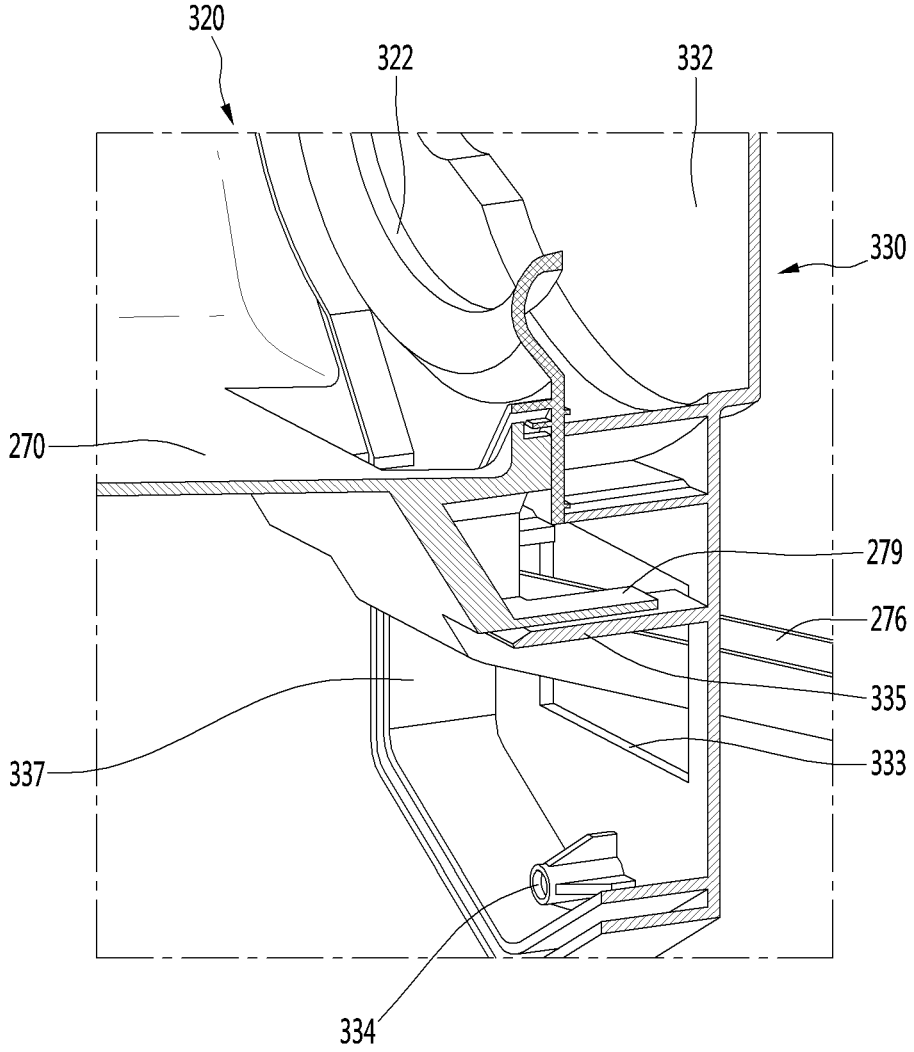
FIG. 22 illustrates a state in which the second cover of the evaporator case is arranged through the second grill cover according to the embodiment of the present disclosure.

The coupling guide 337 may further include cover support members 335 supporting a rear portion of the second cover 270. The cover support members 335 may be provided on one surface of the coupling guide 337 to extend in a transverse direction, and may be configured to support support protrusions 279 (see FIG. 21) provided on a rear side of the second cover 270. As an example, the cover support members 335 may be provided in plurality, and may extend from opposite inner surfaces of the coupling guide 337 in a transverse direction.

An upper portion of the coupling guide 337 may function as a water collector configured to collect the condensate generated inside the blower fan 350 or the first and second grill covers 320 and 330. Discharge guides 336*a* and 336*b* configured to discharge the condensate generated by the blower fan 350 to the lower side may be provided at an upper portion of the coupling guide 337. The discharge guides 336*a* and 336*b* may be located below the blower fan 350.

The discharge guides 336*a* and 336*b* may include a first discharge guide 336*a* and a second discharge guide 336*b* that define a condensate hole. The first discharge guide 336*a* may extend from a first surface of the coupling guide 337 in a first direction, and the second discharge guide 336*b* may extend from a second surface of the coupling guide 337 in a second direction. As an example, based on FIG. 12, the first surface and the second surface may correspond to a right surface and a left surface, respectively, and the first direction and the second direction may correspond to a leftward direction and a rightward direction.

The first discharge guide 336*a* and the second discharge guide 336*b* may be spaced apart from each other, and the space may define the condensate hole 336*c*. The condensate hole 336*c* may be located above the second cover inserting hole 333.

The first discharge guide 336*a* and the second discharge guide 336*b* may be inclined downward. Further, with respect to the horizontal surface, an inclined angle 81 of the first discharge guide 336*a* and an inclined angle 82 of the second discharge guide 336*b* may be different from each other. As an example, the angle 81 may be larger than the angle 82.

Further, the height of the first discharge guide 336*a* may be relatively higher than the height of the second discharge guide 336*b*. In other words, the uppermost height of the first discharge guide 336*a* may be higher than the uppermost height of the second discharge guide 336*b*, and the lowermost height of the first discharge guide 336*a* may be higher than the lowermost height of the second discharge guide 336*b*.

An extending direction of the first discharge guide 336*a* and an extending direction of the second discharge guide 336*b* may intersect each other. In other words, the first discharge guide 336*a* and the second discharge guide 336*b* may be arranged to vertically overlap each other. As an example, a vertical virtual line 11 passing through an end of the first discharge guide 336 may pass through the second discharge guide 336*b*.

While the cold air flows through the blower fan 350, the condensate may be generated around the fan assemblies 350 and 355. Further, the condensate may be collected at an upper portion of the coupling guide 337 and may drop to the defrosting water tray 240 through the condensate hole 336*c*.

When the first discharge guide 336*a* and the second discharge guide 336*b* are located at the same height, and the extending directions of the first and second discharge guides 336*a* and 336*b* may be symmetric to each other toward the condensate hole 336*c*, the cold air may leak through the condensate hole 336*c* while the blower fan 350 rotates. In this case, the condensate existing around the coupling guide 337 may be frozen. Thus, in the present embodiment, the first and second discharge guides 336*a* and 336*b* may be configured as described above, so that the problems may be solved.

Figure 12:
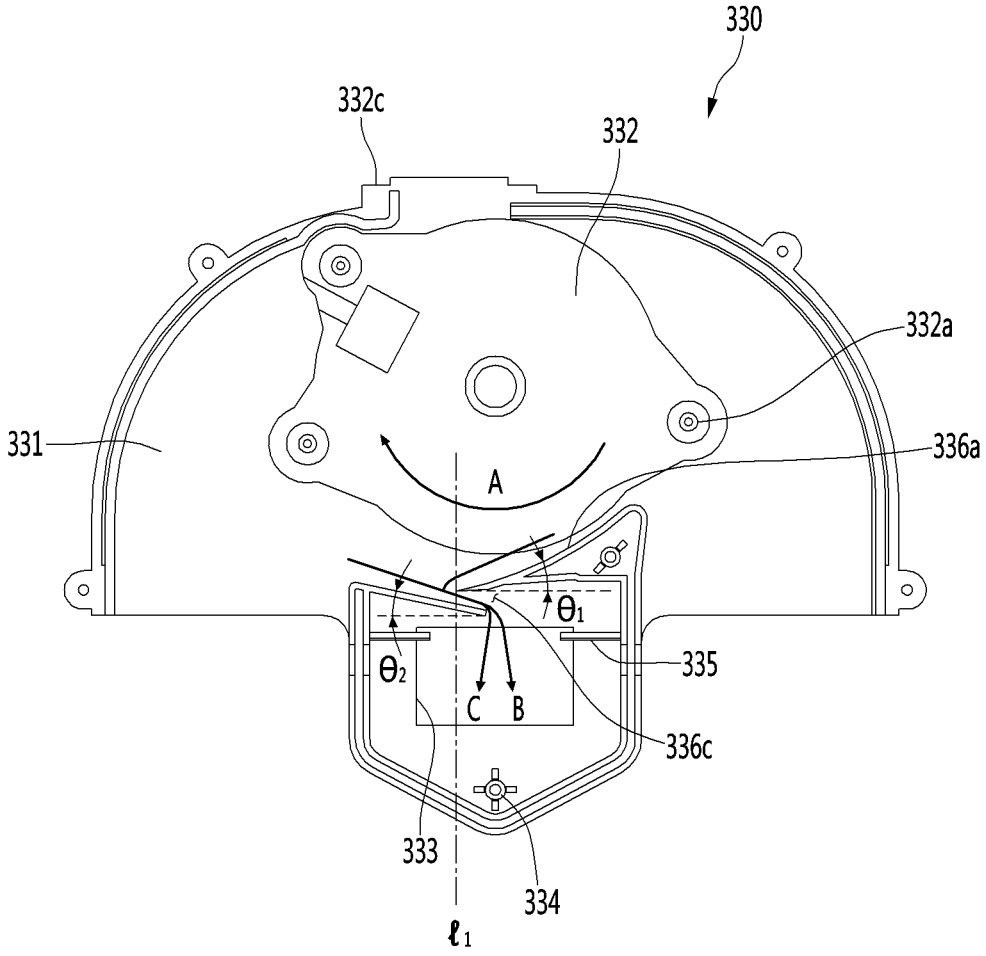
FIG. 12 is a front view illustrating the configuration of the second grill cover according to the embodiment of the present disclosure.

As an example, when the blower fan 350 rotates in a clockwise direction A with respect to FIG. 12, the cold air generated by the blower fan 350 may not be discharged to the lower side through the condensate hole 336*c* by the first and second discharge guides 336*a* and 336*b* arranged to intersect each other when viewed from above. Further, the defrosting water existing on the upper side of the first discharge guide 336*a* may be discharged toward the condensate hole 336*c* in a direction B, and the defrosting water existing on the upper side of the second discharge guide 336*b* may be discharged to the condensate hole 336*c* in a direction C. As an example, the direction B and the direction C may be different from each other. According to such a structure and an effect of the condensate, the condensate may be easily discharged.

The condensate hole 336*c* may be located on an upper side of the second cover inserting hole 333 and the defrosting water tray 240 may pass through the second cover inserting hole 333, so that the defrosting water dropped through the condensate hole 336*c* may be collected in the defrosting water tray 240. According to such a configuration, the condensate generated by the fan assemblies 350 and 355 may be easily discharged.

The flow supply device 300 may further include discharge ducts 311 coupled to the evaporator cases 210 and 270 to guide the cold air stored in the refrigerator compartment 12 to the insides of the evaporator cases 210 and 270, that is, toward the evaporator 220. The discharge ducts 311 may be coupled to the inner refrigerator compartment case 71 to extend downward, and may be coupled to the evaporator cases 210 and 270.

Discharge holes 312 which communicate with the refrigerator compartment 12 and into which the cold air in the refrigerator compartment 12 is introduced may be included in upper portions of the discharge ducts 311. A plurality of first grills 312*a* may be provided in the discharge holes 312 to prevent foreign matters existing in the refrigerator compartment 12 from being introduced into the discharge ducts 311 through the discharge holes 312. The discharge holes 312 may be understood as spaces formed between the plurality of first grills 312*a*.

Further, evaporator supply parts or ports 313 coupled to the evaporator cases 210 and 270 to introduce the cold air discharged from the refrigerator compartment 12 into the installation space for the evaporator 220 may be formed at lower portions of the discharge ducts 311. As an example, the evaporator supply ports 313 may be coupled to the first duct couplers 217 of the first cover 210.

The discharge ducts 311 may be provided on opposite sides of the evaporator cases 210 and 270. Thus, the cold air stored in the refrigerator compartment 12 may be discharged to opposite sides of the inner refrigerator compartment case 71 and may be supplied to the insides of the evaporator cases 210 and 270 through the discharge ducts 311. Further, the supplied air may be cooled while passing through the evaporator 220.

The flow supply device 300 may further include a first supply duct 380 through which at least a portion of the air having passed through the blower fan 350 flows. As an example, the first supply duct 380 may be coupled to the duct couplers 327 and 332*c* to guide a flow of the cold air to be supplied to the refrigerator compartment 12. The duct couplers 327 and 332*c* may be inserted into the grill cover coupler 218.

A cold air duct connector 382 connected to the refrigerator compartment cold air duct 81 may be formed at an upper portion of the first supply duct 380. Thus, the cold air flowing through the first supply duct 380 may be introduced into the refrigerator compartment cold air duct 81 to flow upward and may be supplied to the refrigerator compartment 12 through the refrigerator compartment cold air supplying ports 82.

The third grill cover 340 may further include a cover duct 349 through which at least a portion of the cold air passing through the blower fan 350 flows. As an example, the cover duct 349 may guide a flow of the cold air to be supplied to the freezer compartment 13, and may define a lower configuration of the third grill cover 340. Further, a duct supply part or port 349*a* configured to discharge the cold air to the freezer compartment 13 may be formed at a lower portion of the cover duct 349.

A portion of the cold air passing through the blower fan 350 may flow upward and may be supplied to the refrigerator compartment 12 through the first supply duct 380. Further, the remaining cold air may flow to opposite sides of the blower fan 350, and a portion of the remaining cold air may be supplied to an upper space of the freezer compartment 13 through the plurality of first supply ports 325.

The cold air not supplied through the first supply ports 325 may further flow downward, and may be supplied to a central space of the freezer compartment through the second supply port 346. Further, the cold air not supplied through the second supply port 346 may further flow downward, may be introduced into the cover duct 349, and may be supplied to a lower space of the freezer compartment 13 through the duct supply port 349*a*.

Figure 13:
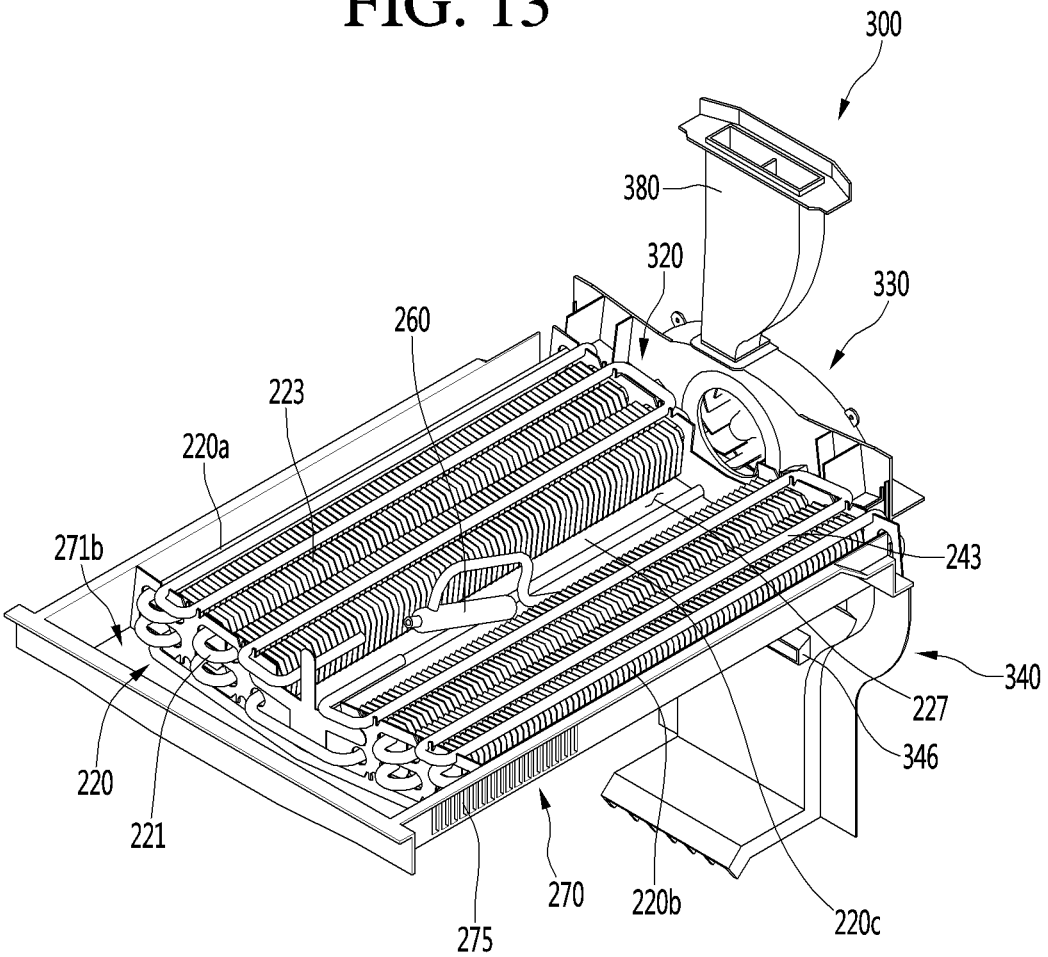
FIG. 13 is a view illustrating configurations of an evaporator and a flow supply part installed in a second cover of evaporator cases according to the embodiment of the present disclosure.
Figure 14:
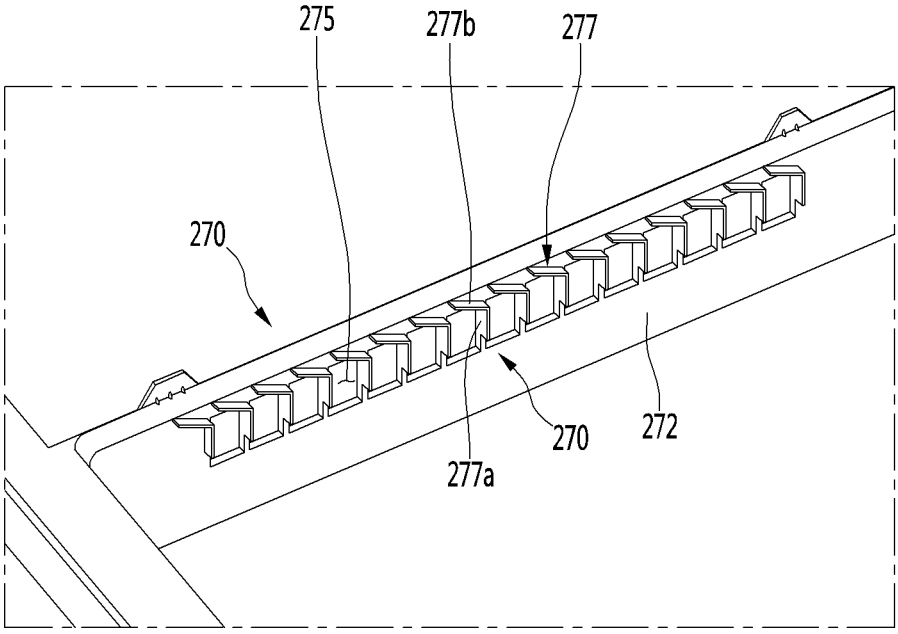
FIG. 14 illustrates a configuration of a side surface of the second cover.
Figure 15:
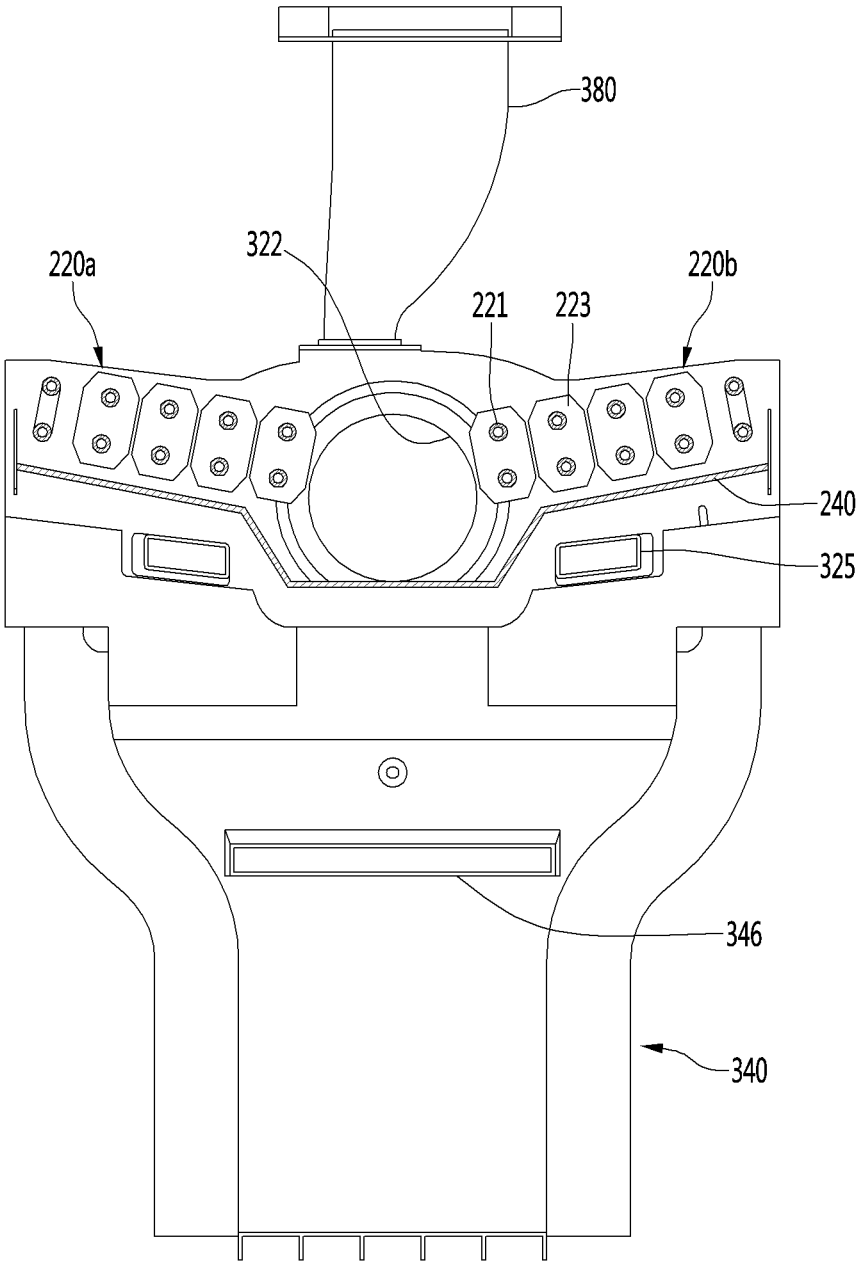
FIG. 15 is a sectional view illustrating the evaporator, a defrosting water tray, and the flow supply part according to the embodiment of the present disclosure.

Referring to FIGS. 13 to 15, the cold air supplying device 100 according to the embodiment of the present disclosure may include the evaporator 220 installed inside the evaporator cases 210 and 270. The evaporator 220 may include the refrigerant pipes 221 through which the refrigerant flows and the fins 223 coupled to the refrigerant pipes 221. As an example, the refrigerant pipes 221 may be shaped to be bent several times, may extend transversely, and may be vertically arranged in two rows. According to such a configuration, a flow distance of the refrigerant may be increased, so that a heat exchange amount may be increased.

The fins 223 may vertically extend to be coupled to the two-row refrigerant pipes 221, and may guide a flow of the cold air to promote heat exchange between the cold air and the refrigerant. According to the refrigerant pipes 221 and the fins 223, heat exchange performance of the refrigerant may be improved.

The fins 223 may be provided in plurality. The plurality of fins 223 may be spaced apart from each other in a front-rear direction. Further, at least some of the plurality of fins 223 may extend from lateral sides toward a central side of the evaporator 220 to guide flow of the cold air from the lateral sides to the central side.

The gas-liquid separator 260 configured to separate a gas refrigerant of the refrigerant passing through the evaporator 220 and supply the separated gas refrigerant to the suction pipe 290 may be installed in an exit of the outlet pipe. The gas-liquid separator 260 may be installed in a fan suction passage 227. According to such arrangement of the gas-liquid separator 260, the gas-liquid separator 260 may be arranged at a relatively low position, and accordingly, the vertical height of the cold air supplying device 100 may be reduced.

The evaporator 220 may further include the first heater 243 coupled to an upper portion of the refrigerant pipes 221 to provide a predetermined amount of heat to the evaporator 220 at a defrosting time of the evaporator 220 so as to melt ice frosted in the refrigerant pipes 221 or the fins 223. The evaporator 220 may include side parts or portions defining opposite portions of the evaporator 220 and a central part or portion defining a central portion of the evaporator 220. The side parts may include a plurality of heat exchangers 220*a* and 220*b*. Further, the central part or portion 220*c* may include the fan suction passage 227 formed between the plurality of heat exchangers 220*a* and 220*b* to define a suction-side passage of the blower fan 350.

The plurality of heat exchangers 220*a* and 220*b* may include a first heat exchanger 220*a* and a second heat exchanger 220*b*. Further, the fan suction passage 227 may be a cold air passage not having the refrigerant pipes 221 and the fins 223. According to such a configuration, the cold air cooled while passing through the first and second heat exchangers 220*a* and 220*b* may be joined to each other in the fan suction passage 227 and may flow toward the blower fan 350. Further, the first and second heat exchangers 220*a* and 220*b* may include the refrigerant pipes 221 and the fins 223.

The cold air supplying device 100 may include the first holder 231 supporting a front portion of the evaporator 220 and the second holder 233 supporting a rear portion of the evaporator 220. The first holder 231 or the second holder 233 may include through-holes 234*b* on which the refrigerant pipes 221 are supported (see FIG. 17).

The first and second covers 231 and 233 may be supported on opposite sides of the second cover 270. Holder supports 272*a* supporting the first holder 231 or the second holder 233 may be provided on side surfaces of the second cover 270, that is, second side cover parts 272. As an example, the holder supports 272*a* may include ribs provided on inner surfaces of the second side cover parts 272 and having insertion holes such that at least a portion of the first holder 231 or the second holder 233 may be inserted thereinto.

Side guides 277 may be provided in the second side covers 272. The side guides 277 may include a plurality of ribs defining the cover discharge holes 275. The plurality of ribs may be spaced apart from each other in a front-rear direction. Each of the side guides 277 may include a first guide extension 277*a* extending upward from a lower end of the corresponding cover discharge hole 275 and a second guide extension 277*b* extending from the first guide extension 277*a* to be inclined upward.

The condensate existing in the evaporator cases 210 and 270 or the defrosting water generated while ice is melted may be discharged through the defrosting water tray 240. When water existing adjacent to the cover discharge holes 275 is discharged to the outside through the cover discharge holes 275, the water may be introduced into the storage chambers of the refrigerator.

In particular, when the blower fan 350 is switched off so that the flow of the cold air into the cover discharge holes 275 does not occur, this problem may become even more serious. Thus, as the side guides 277 are provided inside the cover discharge holes 275, the water existing on the upper side of the second cover 270 may be easily discharged to the lower side, so that the water may be prevented from being introduced into the storage chambers of the refrigerator.

The first heat exchanger 220*a* and the second heat exchanger 220*b* may extend from the central portion to the lateral sides of the evaporator 220 to intersect each other. In other words, the first heat exchanger 220*a* and the second heat exchanger 220*b* may be inclined upward toward the lateral sides with respect to the fan suction passage 227.

According to a configuration of the evaporator 220, a vertical height of the cold air supply 100 may be relatively reduced, so that a storage space of the freezer compartment 13 may be relatively increased. Further the vertical height of the cold air supply 100 may not be large, so that the relatively large thickness of the partition wall insulator 55 located in the partition wall 50 may be secured. As a result, there is an advantage in that even while the thickness of the partition wall insulator 55 is relatively increased, the entire thicknesses of the partition wall 50 and the cold air supply 100 may be relatively reduced.

Further, as compared with an evaporator horizontally arranged in a transverse direction, the heat exchange area of the evaporator 220 is relatively increased, so that heat exchange performance may be improved. According to a configuration in which the evaporator 220 is inclined in a V shape, the first and second holders 231 and 233 supporting a front portion and a rear portion of the evaporator 220 may be also upward inclined from a central portion toward opposite sides thereof.

The defrosting water tray 240 configured to collect the defrosting water generated by the evaporator 220 may be installed on a lower side of the evaporator 220. The defrosting water tray 240 may be spaced downward apart from a lower end of the evaporator 220 to store the defrosting water dropped from the evaporator 220. The defrosting water tray 240 may have a water collecting surface inclined downward to correspond to inclined arrangement of the evaporator 220.

Figure 16:
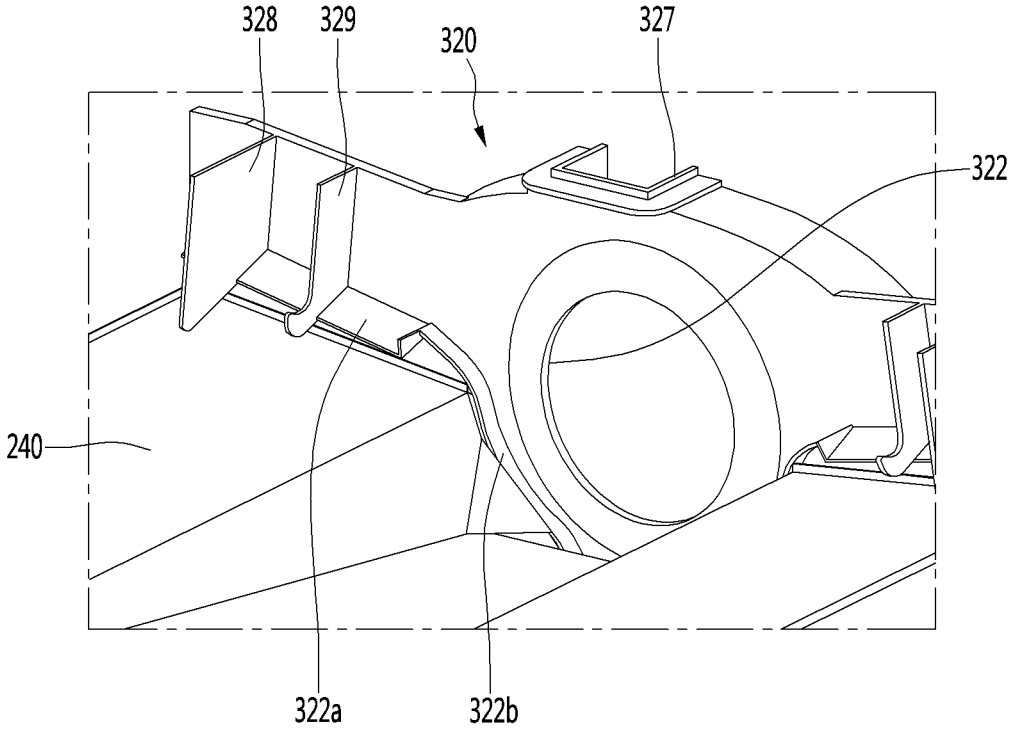
FIG. 16 illustrates a rear portion of the defrosting water tray and a configuration of the first grill cover according to the embodiment of the present disclosure.
Figure 17:
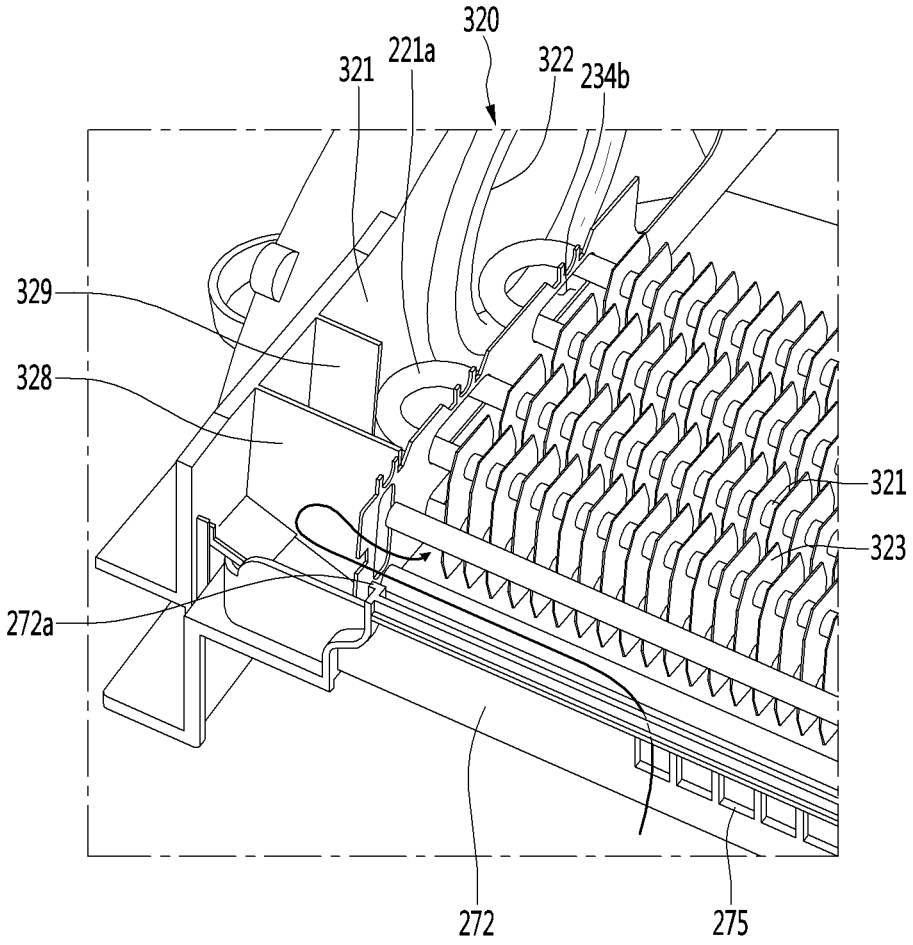
FIG. 17 illustrates a rear portion of the evaporator and a configuration of the first grill cover according to the embodiment of the present disclosure.
Figure 18:
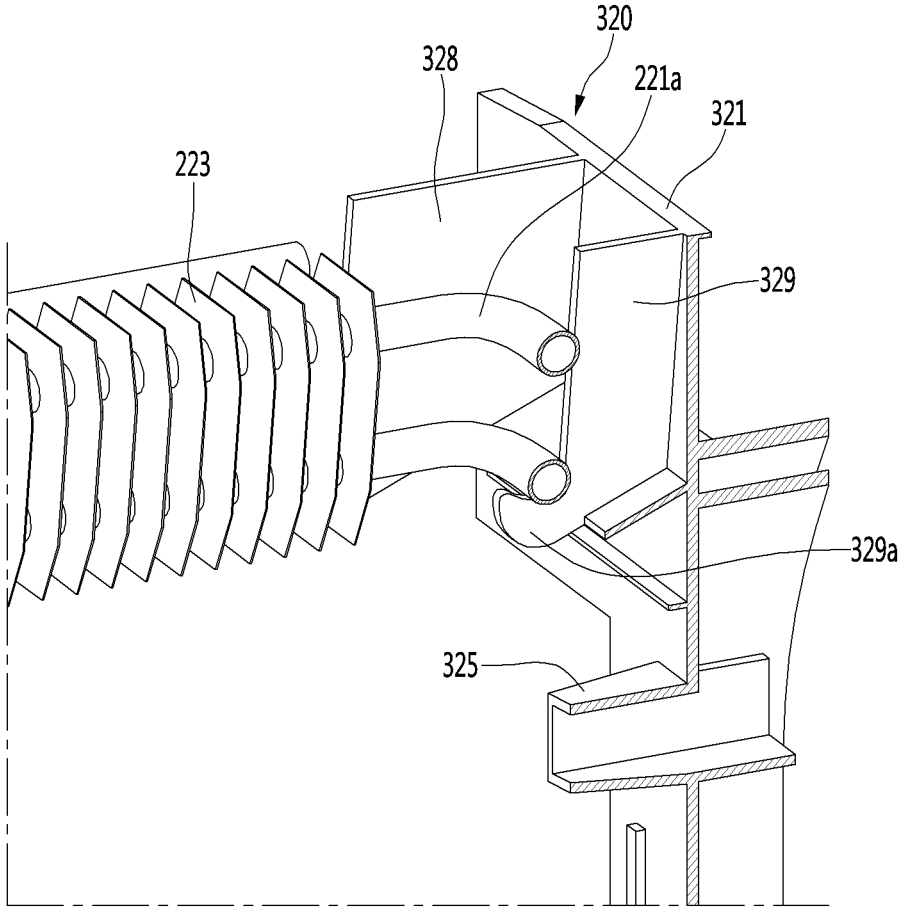
FIG. 18 is a sectional view illustrating a state in which a refrigerant pipe of the evaporator is supported on the first grill cover according to the embodiment of the present disclosure.
Figure 19:
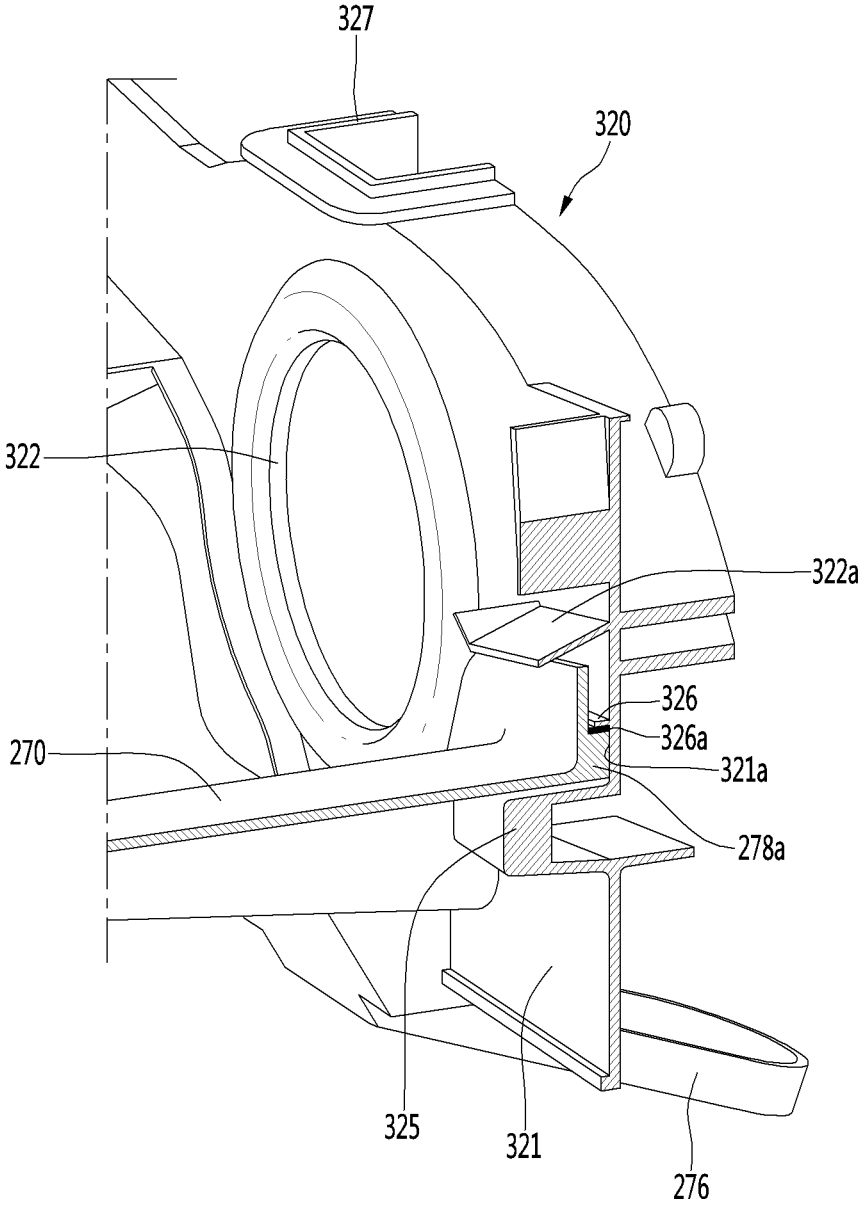
FIG. 19 is a sectional view illustrating a state in which the second cover and the first grill cover are coupled to each other according to the embodiment of the present disclosure.
Figure 20:
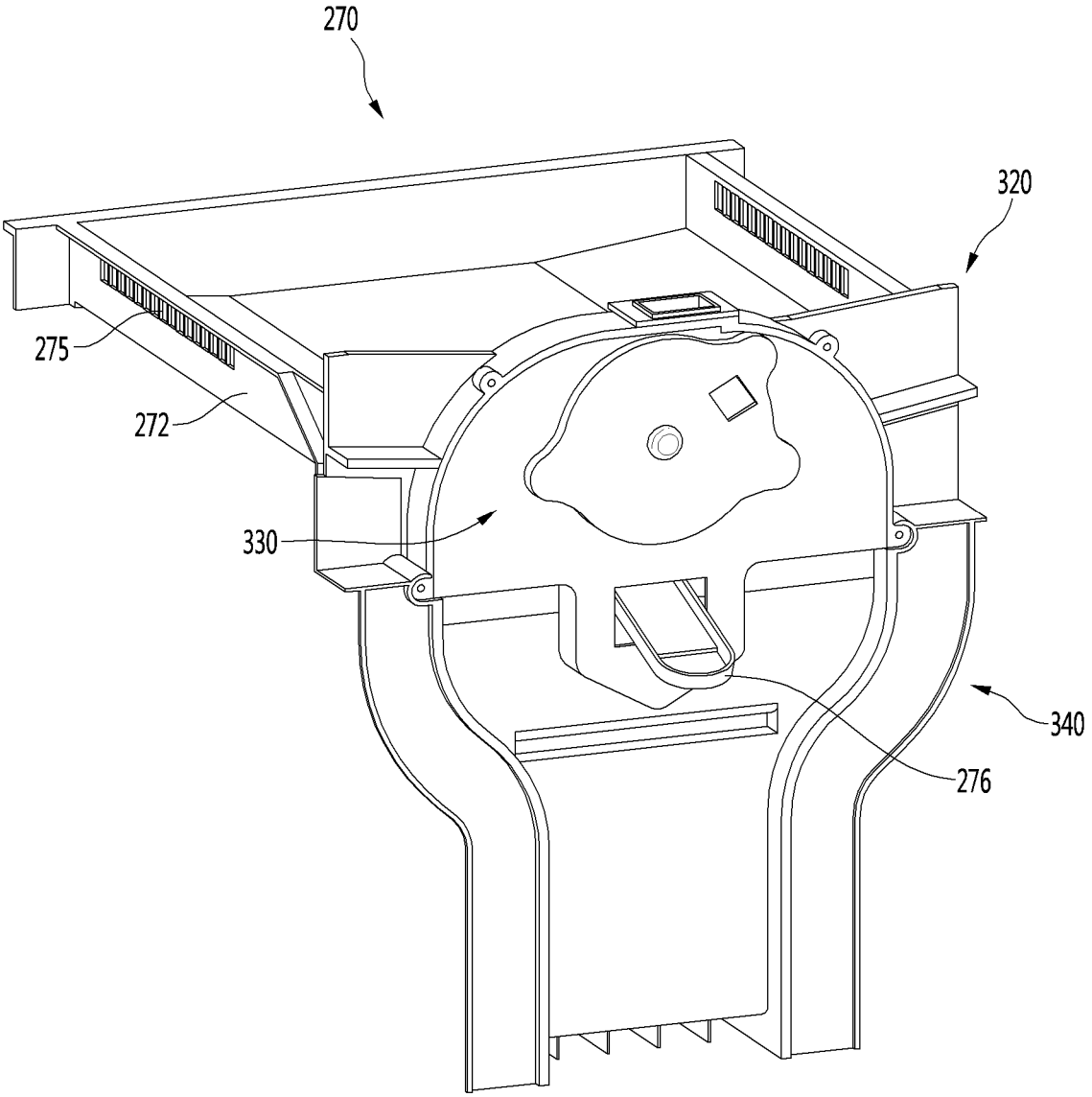
FIG. 20 is a rear perspective view illustrating a state in which the flow supply part is coupled to the second cover of an evaporator case according to the embodiment of the present disclosure.

Referring to FIGS. 16 to 18, the defrosting water tray 240 according to the embodiment may be arranged on a front side of the first grill cover 320, and the condensate or the defrosting water collected in the defrosting water tray 240 may flow to the rear side of the grill covers 320, 330, and 340 through the first cover inserting portion 324, 342, and 344, and the second cover inserting hole 333. At this time, the water existing on the front surface of the first grill cover 320 may be collected in the defrosting water tray 240 along the condensate guides 322*a* and 322*b*.

The blocking walls 328 may be provided on the front surface of the first grill cover 320. The blocking walls 328 may be arranged on a rear side of the second holder 233 supporting a rear portion of the evaporator 220. In other words, the blocking walls 328 may block a space between the front surface of the first grill cover 320 and the second holder 233. As an example, the blocking walls 328 may support a rear portion of the second holder 233.

Further, the blocking walls 328 may be located closer to side surfaces of the first grill cover 320 than the support guides 329. In other words, the support guides 329 may be located between the blocking walls 328 and the fan suction hole 322. Thus, the blocking walls 328 may prevent the air from flowing from lateral sides of the evaporator 220 toward the fan suction hole 322.

According to arrangement of the blocking walls 328, a space formed between the first grill cover 320 and the evaporator 220 may be limited as functioning as a cold air passage. Thus, because the air suctioned by the cover discharge holes 275 and flowing to the rear side is blocked by the blocking walls 328, the air may fail to flow to the fan suction hole 322 and may pass through the evaporator 220. As a result, the air introduced into the evaporator cases 210 and 270 may be restrained from bypassing the evaporator 220, so that heat exchange efficiency through the evaporator 220 may be improved.

The support guides 329 may be provided on the front surface of the first grill cover 320. The support guides 329 may be spaced apart from the blocking walls 328 toward the fan suction hole 322. The support guides 329 may include first pipe supports 329*a* supporting bent pipes 221*a* of the refrigerant pipes 221, which may protrude to the rear side of the second holder 233. The first pipe support 329*a* may be provided below the support guides 329, may have a downward recessed shape, and may stably support the bent pipes 221*a*. As a result, the rear portion of the evaporator 220 may be stably supported on the first grill cover 320.

Referring to FIGS. 19 to 22, the second cover 270 according to the embodiment may support a lower side of the defrosting water tray 240. The second cover 270 may pass through the first cover inserting portion 324, 342, and 344 and the second cover inserting hole 333 together with the defrosting water tray 240, to extend toward the rear side of the grill covers 320, 330, and 340, and may communicate with the drain pipe 295.

The second cover 270 may be mounted on the front surface of the first grill cover 320 while moving from the front side to the rear side of the first grill cover 320. Grill cover mounting parts 278*a* inserted into spaces between the mounting guides 326 of the first grill cover 320 and the first support ports 325 may be provided at rear portions of the second cover 270. Further, the first grill cover 320 may include insertion parts or grooves 321*a* which are provided between the mounting guides 326 and the first supply ports 325 and into which the grill cover mounting parts 278*a* may be inserted.

The second cover 270 may be supported on upper portions of the first supply ports 325. The first supply ports 325 may protrude forward from the first grill cover body 321, and at least a portion of the bottom surface of the second cover 270 may be seated on the upper surfaces of the first supply ports 325. The bottom surface of the second cover 270 may be seated on the first supply ports 325, and the grill cover mounting parts 278*a* may be mounted on the insertion grooves 321*a*, so that the second cover 270 may be stably supported on the first grill cover 320. Thus, the defrosting water tray 240 supported by the second cover 270 may be also stably supported on the first grill cover 320.

The seals 326*a* may be arranged between the grill cover mounting parts 278*a* and the mounting guides 326. That is, the seals 326*a* may be provided below the mounting guides 326, and may be in close contact with the upper surfaces of the grill cover mounting parts 278*a*. By the seals 326*a*, leaking of the defrosting water along spaces between the second cover 270 and the mounting guides 326 may be stabilized, and the second cover 270 may be more stably supported on the first grill cover 320.

A cover guide 276 supporting a pipe inserting part (or defrost water guide tab) 242*b* of the defrosting water tray 240 may be included in the rear portion of the second cover 270. The defrost water guide tab 242*b* may be a part protruding rearward from a body of the defrosting water tray 240. The shape of the cover guide 276 may correspond to the shape of the defrost water guide tab 242*b*.

At least portions of the defrost water guide tab 242*b* and the cover guide 276 may be inserted into the drain pipe 295. To achieve this, the left-right widths of the defrost water guide tab 242*b* and the cover guide 276 may be smaller than a diameter of an inlet of the drain pipe 295. Thus, while the defrosting water is discharged, the defrosting water may be prevented from being leaked to the outside of the drain pipe 295.

A discharge hole 276*a* through which water flowing through the defrost water guide tab 242*b* is discharged to the drain pipe 295 may be formed in the cover guide 276. The discharge hole 276*a* may be formed on a rear side of the defrost water guide tab 242*b*. The water flowing through the defrost water guide tab 242*b* may be discharged to the drain pipe 295 through the discharge hole 276*a*.

The second cover 270 may further include support protrusions 279 provided on opposite sides of the cover guide 276. The support protrusions 279 may be supported by the cover support members 335 of the second grill cover 330. The support protrusions 279 may be supported by the cover support members 335, so that the second cover 270 and the defrosting water tray 240 may be stably supported on the second grill cover 330.

Figure 23:
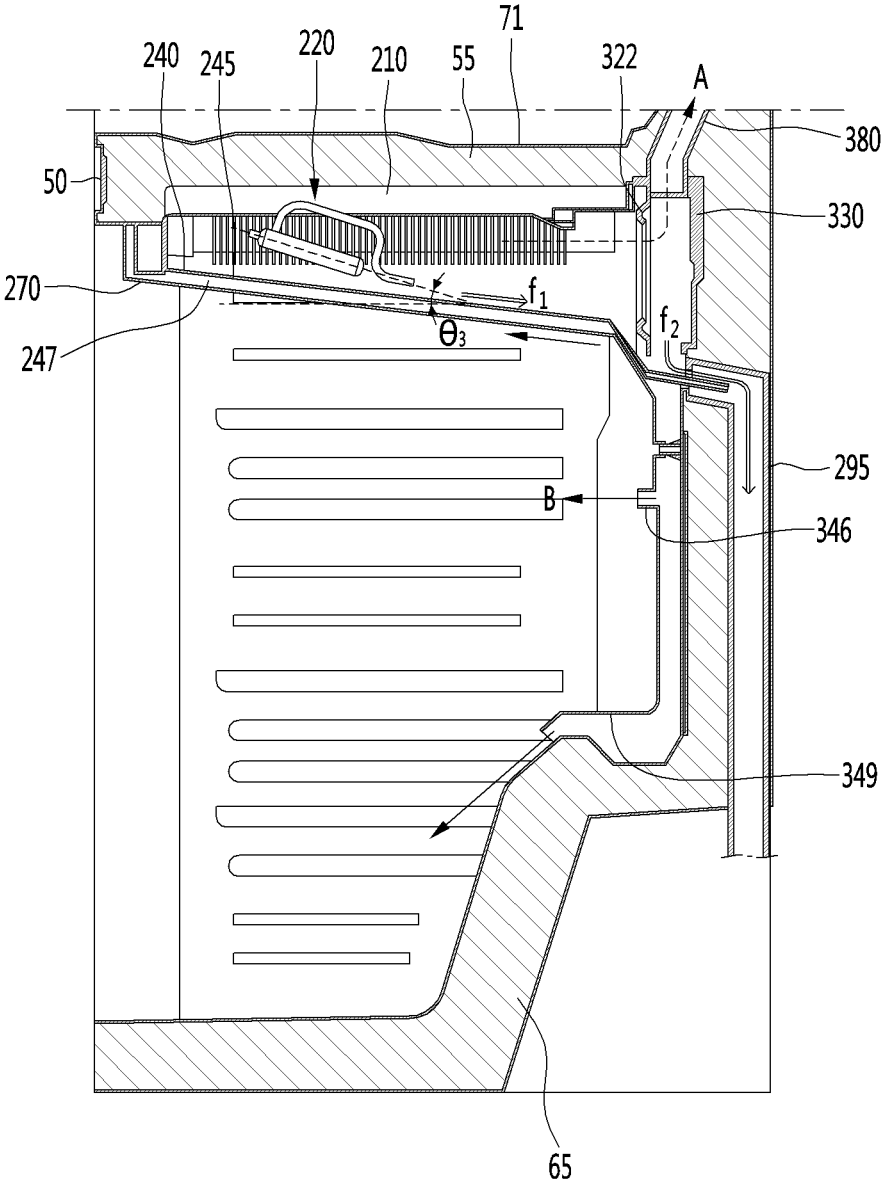
FIG. 23 illustrates a state in which a defrosting water generated by the evaporator is discharged according to the embodiment of the present disclosure.
Figure 24:
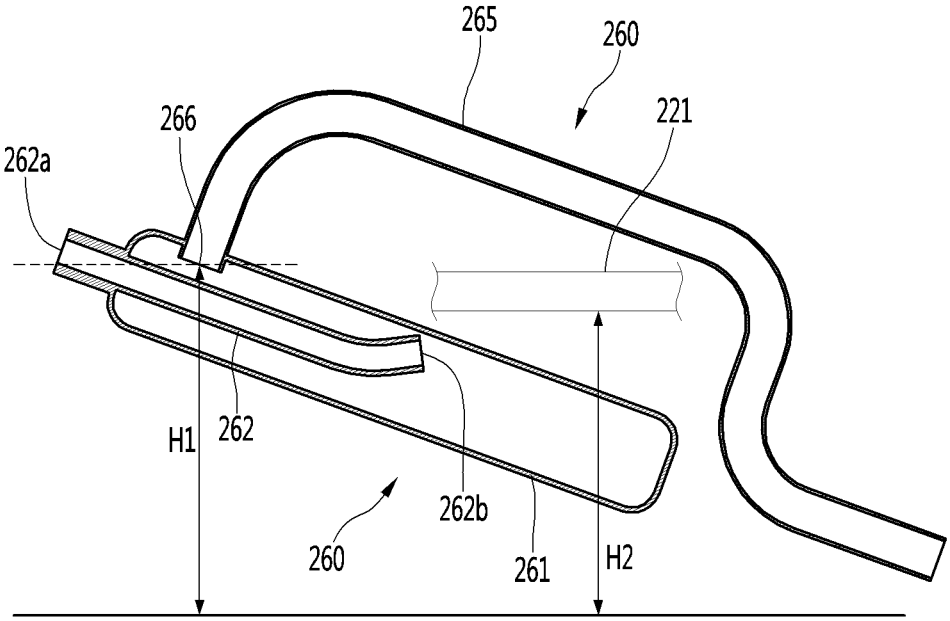
FIG. 24 illustrates a configuration of a gas-liquid separator according to the embodiment of the present disclosure.

Referring to FIGS. 23 and 24, the refrigerator 10 according to the embodiment may further include the gas-liquid separator 260 arranged at an exit of the evaporator 220 to separate a gas refrigerant of the refrigerant passing through the evaporator 220 so as to supply the gas refrigerant to the suction pipe 290. The gas-liquid separator 260 may be arranged in the fan suction passage 227 and may be arranged to be inclined upward by a setting angle 83 with respect to the horizontal surface.

In consideration of a function of the gas-liquid separator 260, the gas-liquid separator 260 may be arranged to stand up in a vertical direction, and a port through which the gas refrigerant is discharged may be arranged at an upper portion of the gas-liquid separator 260. This is because even while the gas refrigerant separated by the gas-liquid separator 260 may be discharged, a liquid refrigerant stored in the gas-liquid separator 260 may be prevented from being discharged.

However, in the present embodiment, when the gas-liquid separator 260 is arranged to stand up in a vertical direction, the vertical height of the cold air supplying device 100 may increase, and accordingly, the height of the partition wall 50 may increase. Thus, in the present embodiment, the gas-liquid separator 260 may be inclined upward by the setting angle 83 with respect to the horizontal surface such that even while the height of the cold air supplying device 100 is relatively reduced, a function of the gas-liquid separator 260 is easily performed. As an example, the setting angle 83 may be formed in a range of 20-40 degrees.

The gas-liquid separator 260 may include a gas-liquid separating body 261 configured to store the refrigerant. The gas-liquid separating body 261 may extend to be upward inclined by the setting angle 83 with respect to the horizontal surface.

The gas-liquid separator 260 may include a refrigerant inlet 262 which is provided above the gas-liquid separating body 261 and into which the refrigerant evaporated by the evaporator 220 is introduced. As an example, the refrigerant inlet 262 may include a pipe, and the pipe may be inserted from an upper portion of the gas-liquid separating body 261 to extend to the inside of the gas-liquid separating body 261. The refrigerant inlet 262 may also extend to be inclined upward with respect to the horizontal surface.

The refrigerant inlet 262 may include an inlet 262*a* and an outlet 262*b*. The inlet 262*a* may guide the refrigerant to the refrigerant inlet 262, and the outlet 262*b* may discharge the refrigerant introduced through the refrigerant inlet 262 to the gas-liquid separating body 261. The inlet 262*a* may be located outside the gas-liquid separating body 261, and the outlet 262*b* may be located inside the gas-liquid separating body 261.

The gas-liquid separator 260 may further include a gas refrigerant discharging part or pipe 265 through which the gas refrigerant among the refrigerant stored in the gas-liquid separating body 261 is discharged. The gas refrigerant discharging pipe 265 may be connected to the suction pipe 290. The gas refrigerant discharging pipe 265 may include a discharge port 266 through which the refrigerant stored in the gas-liquid separating body 261 is introduced into the gas refrigerant discharging part 265.

The height of the discharge port 266 may be higher than the height of an outlet pipe 221 of the evaporator 220. As an example, the height H1 of the discharge port 266 with respect to a predetermined reference surface may be higher than the height H2 of the outlet pipe 221 of the evaporator 220. When the height H1 is lower than the height H2, because the head pressure of the outlet pipe 221 of the evaporator 220 becomes larger than the head pressure of the refrigerant stored in the gas-liquid separating body 261, the refrigerant of the gas-liquid separating body 261 may be introduced into the gas refrigerant discharging pipe 265 through the discharge port 266. Thus, in the present embodiment, the size and the inclination of the gas-liquid separator 260 are determined such that the height H1 is higher than the height H2.

Supply of the cold air and discharge of the defrosting water through the evaporator 220 will be described briefly with reference to FIG. 24. The cold air stored in the storage chambers 12 and 13 according to the embodiment of the present disclosure may be introduced into an evaporation chamber in which the evaporator 220 is located. The cold air stored in the refrigerator compartment 12 may be introduced into the evaporation chamber through the discharge ducts 311 constituting the refrigerator compartment suction passage (dotted line arrow).

Further, the cold air stored in the freezer compartment 13 may be introduced into the evaporation chamber through the cover discharge holes 275 constituting the freezer compartment suction passage. Such flow of the cold air may be performed on opposite sides of the evaporator 220 through the first and second heat exchangers 220*a* and 220*b*. The cold air introduced from the opposite sides of the evaporator 220 may pass through the refrigerant pipes 221 and the fins 223, may be combined with each other in the fan suction passage 227, and then may flow rearward.

Further, the cold air of the fan suction passage 227 may be introduced into the grill covers 320, 330, and 340 through the fan suction port 322 and pass through the blower fan 350. Further, at least a portion of the cold air passing through the blower fan 350 may flow to the refrigerator compartment cold air duct 81 through the first supply duct 380 and may be supplied to the refrigerator compartment 12 through the cold air discharging port 82 (flow A). Further, the remaining cold air among the cold air passing through the blower fan 350 may flow to the first and second supply ports 325 and 346 or the cover duct 349 and may be supplied to the freezer compartment 13 (flow B).

While the cold air is supplied through the evaporator 220, the condensate or the defrosting water f1 may be generated by the evaporator 220, and the condensate or the defrosting water may drop to the defrosting water tray 240 provided below the evaporator 220. The water collected in the defrosting water tray 240 may flow toward the rear side of the defrosting water tray 240. As described above, the defrosting water tray 240 may be downward inclined from the front side toward the rear side thereof, so that the condensate or the defrosting water may easily flow. The water flowing through the defrosting water tray 240 may pass through the grill covers 320, 330, and 340, and may be introduced into the drain pipe 295.

Further, the condensate f2 generated by the blower fan 350 or in the grill covers 320 and 330 may drop to the defrosting water tray 240 through the condensate hole 336*c* and may be introduced into the drain pipe 295. That is, the defrosting water f1 and the condensate f2 may be combined with each other in the defrosting water tray 240 and may be introduced into the drain pipe 295.

The water introduced into the drain pipe 295 may flow downward to be introduced into the machine room 80, and may be collected in the drain fan 85 (see FIG. 25) provided in the machine room 80. According to such an operation, the defrosting water may be easily discharged.

Figure 25:
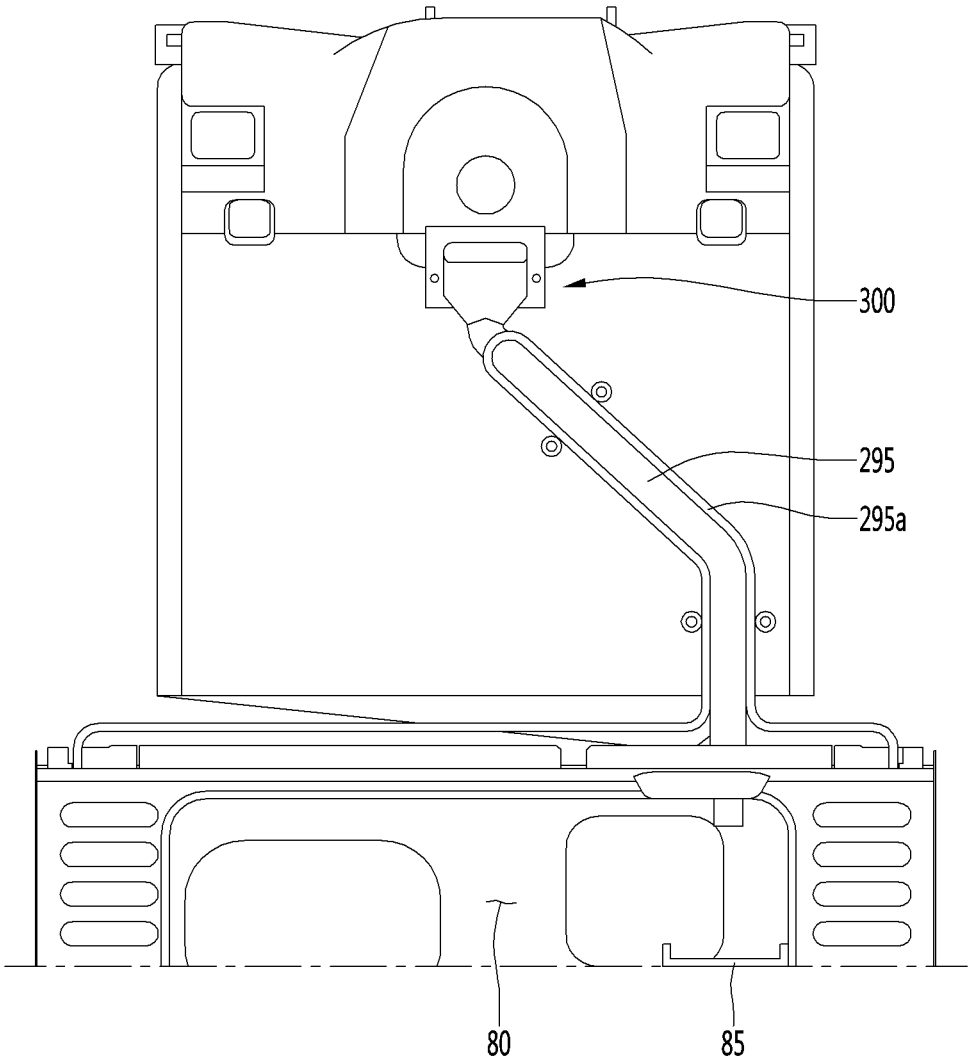
FIG. 25 illustrates a state in which a heat supply pipe is coupled to a drain pipe according to the embodiment of the present disclosure.
Figure 26:
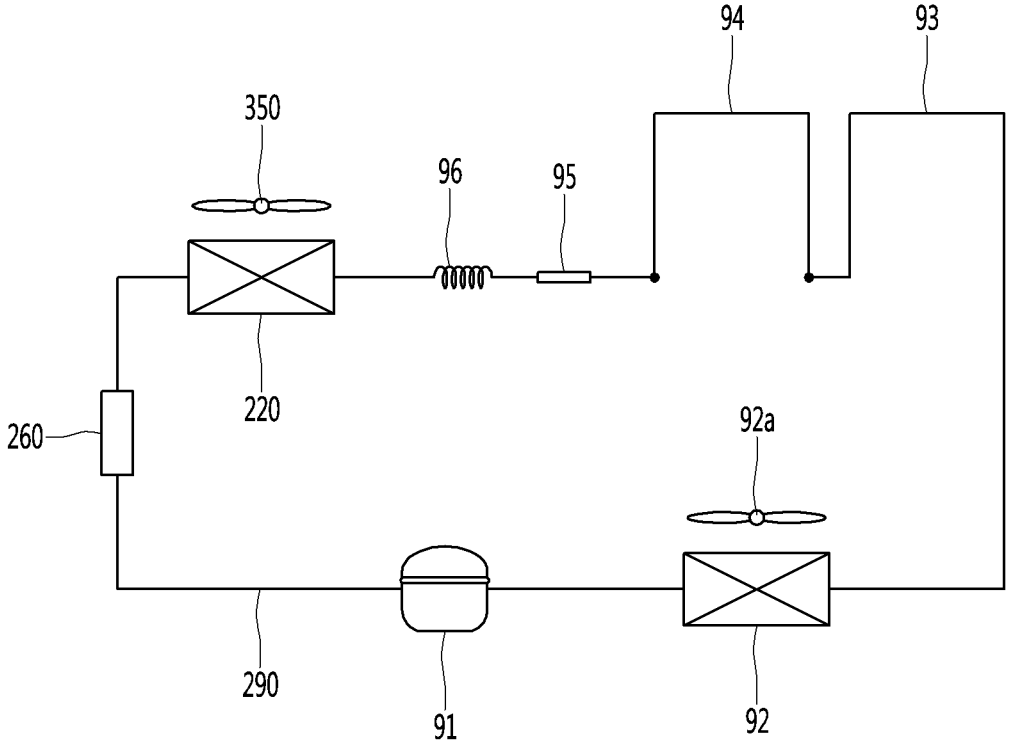
FIG. 26 is a schematic view illustrating a configuration of a refrigeration cycle of the refrigerator according to the embodiment of the present disclosure.

Referring to FIGS. 25 and 26, the refrigerator 10 according to the embodiment may include a compressor 91 configured to compress a refrigerant, a condenser 92 arranged in an outlet side of the compressor 91 to condense the compressed refrigerant, an expansion device 96 configured to decompress the refrigerant condensed by the condenser 92, and the evaporator 220 configured to evaporate the refrigerant decompressed by the expansion device 96. As an example, the expansion device 96 may include a capillary tube. Further, the gas-liquid separator 260 configured to separate the gas refrigerant among the evaporated refrigerant and guide the separated gas refrigerant to the suction pipe 290 of the compressor 91 may be provided in an outlet side of the evaporator 220.

The refrigerator 10 may further include a dryer 95 configured to filter moisture or foreign matters among the refrigerant condensed by the condenser 92. The dryer 95 may be provided on an outlet side of the condenser 92 and on an inlet side of the expansion device 96.

The refrigerator 10 may further include a first hot line pipe 93 which extends from the outlet side of the condenser 92 to the front surface of the cabinet 11 and through which the condensed refrigerant flows. The first hot line pipe 93 may have a portion with which the doors 21 and 22 on the front surface of the cabinet 11 are in close contact to prevent dew from occurring in the cabinet 11 due to a temperature difference between the insides and the outsides of the storage chambers 12 and 13.

The refrigerator 10 may further include a second hot line pipe 94 through which the refrigerant condensed by the condenser 92 flows and which prevents the drain pipe 295 from being frozen. In the present embodiment, because the drain pipe 295 is embedded in the rear surface of the freezer compartment, the drain pipe 295 may have a relatively low temperature. Thus, the drain pipe 295 may be frozen, and when freezing occurs, the defrosting water may fail to be discharged from the drain pipe 295, and may flow back to the cold air supply 100.

Thus, in the present embodiment, the second hot line pipe 94 may supply a predetermined amount of heat to the drain pipe 295, so as to prevent the drain pipe 295 from freezing. As an example, the second hot line pipe 94 may extend from an outlet side of the first hot line pipe 93 and may be connected to the dryer 95. That is, the refrigerant condensed by the condenser 92 may pass through the first hot line pipe 93, and then flow through the second hot line pipe 94. However, the present disclosure is not limited thereto. Further, the second hot line pipe 94 may be connected to the outlet side of the condenser 92, and the first hot line pipe 93 may be connected to an outlet side of the second hot line pipe 94.

The second hot line pipe 94 may be arranged to be in contact with the drain pipe 295. As an example, the second hot line pipe 94 may be coupled to an outer surface of the drain pipe 295 through welding. In this way, the drain pipe 295 may be prevented from being frozen using the condensed refrigerant, so that costs may be reduced as compared to a case where a heater or the like is used.

A refrigerator according to an embodiment of the present disclosure may include a partition wall provided between first and second storage chambers vertically arranged and having a partition wall insulator, an evaporator case arranged in the second storage chamber and provided under a bottom surface of the partition wall, an evaporator installed inside the evaporator case, a grill cover provided on a rear side of the evaporator case and configured to accommodate a blower fan, and support guides provided in the grill cover and supporting a rear portion of the evaporator. The grill cover may include a first grill cover, and the first grill cover may include a fan suction port configured to suction cold air passing through the evaporator and guide the cold air to the blower fan.

The first grill cover may further include a first supply port formed on one side of the fan suction port and configured to discharge the air passing through the blower fan to the second storage chamber. The support guides may be provided on opposite sides of the fan suction port. The evaporator may include refrigerant pipes and fins, and the support guides may support the refrigerant pipes.

The refrigerator may further include a holder coupled to a front portion or a rear portion of the evaporator. The support guides may include a first pipe support supporting bent pipes of the refrigerant pipes, which protrude from the holder. The first grill cover may further include a blocking wall protruding from a front surface of the first grill cover and configured to block a space between the evaporator and the first grill cover, and the blocking wall may restrain the cold air introduced into the evaporator case from bypassing the evaporator and being suctioned into the fan suction port.

The refrigerator may further include a hook device supporting a front portion of the evaporator and coupled to the evaporator case. The grill cover may further include a second grill cover coupled to a rear portion of the first grill cover, and the second grill cover may include a fan seat on which the blower fan is seated, and support guides supporting the evaporator case.

The grill cover may further include a third grill cover coupled to a lower side of the first grill cover, and the third grill cover may include a second supply port configured to discharge the cold air passing through the blower fan to the second storage chamber. The evaporator case may include a first cover provided on a lower side of the evaporator, and a second cover provided on an upper side of the evaporator. The first and second grill covers may include a first cover inserting hole into which the second cover is inserted.

The evaporator may include first and second heat exchangers arranged to be inclined, and a fan suction passage which is formed between the first and second heat exchangers and through which cold air is suctioned to the grill cover. A gas-liquid separator, into which the refrigerant discharged from the evaporator is introduced so that a gas refrigerant is separated, may be arranged in the fan suction passage. The gas-liquid separator may be arranged to be inclined upward by a setting angle with respect to a horizontal surface.

According to the refrigerator having the above-described configuration according to the embodiment of the present disclosure, because an evaporator may be installed on one side of a partition wall by which a refrigerator compartment and a freezer compartment are vertically partitioned, an internal storage space of the refrigerator may be enlarged, and withdrawal distances of drawers provided in the refrigerator may be increased. Thus, storage ability for food may be improved.

Further, the first and second heat exchangers of the evaporator may be inclined from a central portion toward lateral sides of the evaporator, so that the heat exchange area of the evaporator may be increased, and the relatively large thickness of an insulator located in the partition wall may be secured. Further, a predetermined space may be secured between the first and second heat exchangers, so that it is easy to install a component, such as a gas/liquid separator, of the refrigerator or to perform a welding operation.

A defrosting water tray may be provided on a lower side of the evaporator, and the defrosting water tray may be inclined downward from opposite sides to the central portion to correspond to the shape of the evaporator, so that defrosting water may smoothly flow. Because a front portion of the evaporator is supported by a hook apparatus and a lower portion of the evaporator is supported by a grill cover, the evaporator may be stably supported on an interior of an evaporator case. Because a blocking wall is provided in the grill cover, cold air suctioned into the evaporator case may be prevented from bypassing the evaporator and being directly introduced into a side of a blower fan.

A mounting guide may be provided in the grill cover, so that a defrosting water tray is easily mounted, and the defrosting water tray is stably supported by the mounting guide. Further, because a seal is provided between the mounting guide and a rear side of the defrosting water tray, the defrosting water may be prevented from leaking through a coupling portion of the defrosting water tray and the grill cover, and stable coupling between the defrosting water tray and the grill cover may be achieved.

A condensate guide may be provided in the grill cover, so that a condensate occurring around the blower fan may be easily discharged to the defrosting water tray. Further, a guide rib may be provided in the evaporator case, so that the defrosting water existing inside or on the evaporator case may be prevented from dropping into the storage chamber.

A heat supply pipe may be provided in the drain pipe, so that the drain pipe may be prevented from being frozen using a condensed refrigerant having a relatively high temperature. Further, the height of a portion of the gas-liquid separator where a gas refrigerant is bypassed may be higher than an upper end of pipes on an outlet side of the evaporator, so that a liquid refrigerant inside the gas-liquid separator may be prevented from being introduced into a suction pipe.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including a first storage chamber and a second storage chamber;

a partition wall provided between the first and second storage chambers, the partition wall being configured to vertically separate the first and second storage chambers;

an evaporator casing provided at the partition wall and including a first cover and a second cover provided at a lower side of the first cover, the first and the second covers being configured to define a heat exchange chamber;

an evaporator installed inside the heat exchange chamber;

a grill cover provided at a rear side of the evaporator, the grill cover being configured to support a rear portion of the evaporator;

a blower fan received in the grill cover;

a hook provided between the first cover and the second cover, the hook being coupled to the first cover and configured to support a front portion of the evaporator, wherein the hook includes a pipe support configured to support at least one of the refrigerant pipes, and a cover coupler that extends upward from the pipe support and is configured to be coupled to the first case.

2. The refrigerator of claim 1, wherein the evaporator includes refrigerant pipes and a plurality of fins coupled to the refrigerant pipes, and wherein the hook is configured to support the refrigerant pipes.

3. The refrigerator of claim 1, wherein the refrigerant pipes include:

at least one linear pipe to which the fins are coupled; and at least one bent pipe that extends from an end of the linear pipe and connects to adjacent parallel refrigerant pipes.

4. The refrigerator of claim 3, wherein the hook is provided beneath the at least one bent pipe.

5. The refrigerator of claim 3, wherein the pipe support includes a plurality of pipe supports provided at both sides of the cover coupler, and wherein the plurality of pipe supports support a plurality of bent pipes.

6. The refrigerator of claim 1, wherein the first cover includes a hook coupler to which the cover coupler is coupled, and wherein the cover coupler protrudes from a lower surface of the first cover.

7. The refrigerator of claim 6, wherein the first cover includes a first upper cover in which a recess is formed, and wherein the hook coupler is provided at the recess.

8. The refrigerator of claim 7, wherein the evaporator includes:

a first heat exchanger inclined from a central portion of the evaporator toward a first lateral side of the refrigerator; and a second heat exchanger inclined from the central portion of the evaporator toward a second lateral side of the refrigerator opposite the first lateral side.

9. The refrigerator of claim 8, wherein the recess is formed at a center of the first upper cover, and wherein the first upper cover is inclined upward from the recess to the first and the second lateral sides of the refrigerator.

10. The refrigerator of claim 7, wherein the first cover further includes a front cover provided in front of the evaporator and side covers extending rearward from opposite sides of the front cover, wherein the first upper cover connects tops of the side covers to each other.

11. The refrigerator of claim 7, further comprising a first holder provided at a front part of the evaporator and configured to support the refrigerant pipes, wherein the first holder includes through-holes through which portions of the refrigerant pipes pass.

12. The refrigerator of claim 11, wherein the hook contacts the portions of the refrigerant pipes that protrude through the first holder.

13. The refrigerator of claim 2, further comprising at least one support guide provided in the grill cover and configured to support the refrigerant pipes.

14. The refrigerator of claim 13, wherein the grill cover includes a first grill cover, and wherein the first grill cover includes:

a fan suction port configured to suck cold air passing through the evaporator and guide the cold air to the blower fan; and at least one first supply port provided adjacent to the fan suction port and configured to discharge the air passing through the blower fan to the second storage chamber.

15. The refrigerator of claim 14, wherein the at least one support guide includes a plurality of support guides provided on opposite sides of the fan suction port.

16. The refrigerator of claim 14, wherein the grill cover further includes a second grill cover coupled to a rear portion of the first grill cover, and wherein the second grill cover includes:

a fan seat on which the blower fan is seated; and a coupling guide provided adjacent to the fan seat, the coupling guide being configured to protrude forward from a front portion of the second grill cover to support a rear portion of the first grill cover.

17. The refrigerator of claim 14, wherein the grill cover further includes a third grill cover coupled to a lower side of the first grill cover, and wherein the third grill cover includes a second supply port configured to discharge cold air passing through the blower fan to the second storage chamber.

18. The refrigerator of claim 17, wherein at least one of the first grill cover and the third grill cover includes a first cover inserting portion into which the second cover is inserted, and wherein the first cover inserting portion includes a first recess recessed upward from a lower edge of the first grill cover and a second recess recessed downward from an upper edge of the third grill cover.

19. The refrigerator of claim 11, further including a second holder coupled to a rear portion of the evaporator, wherein the at least one support guide includes a first pipe support that supports a bent portion of the refrigerant pipes which protrude from the second holder.

20. A refrigerator comprising:

a cabinet including a first storage chamber and a second storage chamber;

a partition wall provided between the first and second storage chambers, the partition wall being configured to vertically separate the first and second storage chambers;

an evaporator casing provided at the partition wall and including a first cover and a second cover provided at a lower side of the first cover, the first and the second covers being configured to define a heat exchange chamber;

an evaporator installed inside the heat exchange chamber, the evaporator including a first refrigerant pipe and a second refrigerant pipe spaced apart from the each other;

a grill cover provided at a rear side of the evaporator, the grill cover being configured to support a rear portion of the evaporator;

a blower fan received in the grill cover; and a hook provided between the first cover and the second cover and configured to support a front portion of the evaporator, wherein the hook includes a first portion provided between the first and the second refrigerant pipes, and a second portion extending from the first portion and coupled to the first cover.

21. A refrigerator comprising:

a cabinet including a first storage chamber and a second storage chamber;

a partition wall provided between the first and second storage chambers, the partition wall being configured to vertically separate the first and second storage chambers;

an evaporator casing provided at the partition wall and including a first cover and a second cover provided at a lower side of the first cover, the first and the second covers being configured to define a heat exchange chamber;

an evaporator installed inside the heat exchange chamber, the evaporator including refrigerant pipes;

a grill cover provided at a rear side of the evaporator, the grill cover being configured to support a rear portion of the evaporator;

a blower fan received in the grill cover; and a hook provided between the first cover and the second cover and configured to support a front portion of the evaporator, wherein the hook includes a center portion extending vertically and coupled to the first cover, and a pair of side portions provided at both sides of the center portion and configured to support the refrigerant pipes.

22. A refrigerator comprising:

a cabinet including a first storage chamber and a second storage chamber;

a partition wall provided between the first and second storage chambers, the partition wall being configured to vertically separate the first and second storage chambers;

an evaporator casing provided at the partition wall and including a first cover and a second cover provided at a lower side of the first cover, the first and the second covers being configured to define a heat exchange chamber;

an evaporator installed inside the heat exchange chamber;

a grill cover provided at a rear side of the evaporator, the grill cover being configured to support a rear portion of the evaporator;

a blower fan received in the grill cover; and a hook provided between the first cover and the second cover and configured to support a front portion of the evaporator, wherein the evaporator includes a first heat exchanger and a second heat exchanger in which refrigerant pipes are provided, and wherein a fan suction passage, through which air is introduced into the blower fan, is formed between the first and second heat exchangers, and the hook is located in the fan suction passage.

23. A refrigerator comprising:

a cabinet including a first storage chamber and a second storage chamber;

a partition wall provided between the first and second storage chambers, the partition wall being configured to vertically separate the first and second storage chambers;

an evaporator casing provided at the partition wall and including a first cover and a second cover provided at a lower side of the first cover, the first and the second covers being configured to define a heat exchange chamber;

an evaporator installed inside the heat exchange chamber, the evaporator including refrigerant pipes;

a grill cover provided at a rear side of the evaporator, the grill cover being configured to support a rear portion of the evaporator;

a blower fan received in the grill cover;

a hook provided between the first cover and the second cover and configured to support a front portion of the evaporator; and a holder provided at the front portion of the evaporator and formed with a through hole through which the refrigerant pipes pass, wherein the hook includes a pipe support to support at least a portion of the refrigerant pipes that protrudes forward from the through hole.

* * * * *